US006561751B1

(12) United States Patent
Ishizaki et al.

(10) Patent No.: US 6,561,751 B1
(45) Date of Patent: May 13, 2003

(54) ACTUATOR CONTROL DEVICE AND BUCKET POSTURE CONTROL DEVICE FOR HYDRAULIC DRIVE MACHINE

(75) Inventors: Naoki Ishizaki, Kawachi-gun (JP); Shuuji Hori, Oyama (JP); Shinobu Nagura, Oyama (JP)

(73) Assignee: Komatsu Ltd., Tokyo (JP)

( * ) Notice: Subject to any disclaimer, the term of this patent is extended or adjusted under 35 U.S.C. 154(b) by 58 days.

(21) Appl. No.: 09/666,138

(22) Filed: Sep. 20, 2000

(30) Foreign Application Priority Data

Sep. 21, 1999 (JP) ..... 11-267134

(51) Int. Cl.[7] ..... B66F 9/00
(52) U.S. Cl. ..... 414/700; 91/520
(58) Field of Search ..... 414/700, 708, 414/699; 91/508, 511, 517, 520, 361, 459

(56) References Cited

U.S. PATENT DOCUMENTS 4,799,851 A * 1/1989 Swanson ..... 414/700
5,447,094 A * 9/1995 Geyler, Jr. ..... 414/700 X
5,669,282 A * 9/1997 Tanino et al. ..... 414/700 X

* cited by examiner

*Primary Examiner*—Donald W. Underwood
(74) *Attorney, Agent, or Firm*—Varndell & Varndell, PLLC

(57) ABSTRACT

A high versatility can be obtained, the pipe laying can be configured easily and, by virtue of the fact that a pilot pressured oil is managed, a hydraulic apparatus can be compacted. A differential pressure ΔP between a pressure of the pressured oil on an upstream side and a pressure of the pressured oil on a downward side of operation valves is set to a certain value by a front-to-rear differential pressure stabilizer. As a result, flow rates Q1, Q2 of the operation valves are determined univocally in accordance with opening surface areas (opening amounts) A1, A2 of the operation valves, irrespective of load fluctuations, that is to say, a fluctuation of ΔP. When one of operation members are operated, the opening amount A2 of the other operation valve correspondent with the other operation member is changed in accordance with an operation amount S1 of that operation member, and the other hydraulic actuator correspondent with the other operation valve is driven.

5 Claims, 6 Drawing Sheets

ACTUATOR CONTROL DEVICE AND BUCKET POSTURE CONTROL DEVICE FOR HYDRAULIC DRIVE MACHINE

BACKGROUND OF THE INVENTION

1. Field of the Invention

The present invention relates to a device which performs the drive control of two hydraulic actuators. In addition, the present invention relates to a device which performs the drive control of a boom hydraulic actuator and a bucket hydraulic actuator such that a posture of the bucket provided in the hydraulic drive machine is held constant.

2. Description of the Related Art

Booms and buckets are provided as work devices in construction machine such as wheel loaders and skid-stair loaders and so on.

By way of example, using a wheel loader, work is performed in which, following the excavation of the earth and sand with the bucket, the boom is raised whereby the earth and sand within the bucket is loaded into a dump truck. For the boom to be actuated in the upward direction during this work operation, the bucket must be actuated in the dumping direction in such a way that the posture of the bucket is held in a constant horizontal state with respect to the ground surface. This horizontal hold control is indispensable in preventing the earth and sand and so on within the bucket from spilling.

However, when the above-noted horizontal hold control is entrusted to the manual operation of the operator only, the dual operation of a boom operation unit and bucket operation unit must be performed. This dual operation places a large burden on the operator and requires experience. For this reason, an invention in which the abovementioned horizontal hold control can be performed without burden on the operator, and for which no experience is required, has been hitherto well known. That is to say, an invention in which the boom and the bucket are simultaneously actuated by the boom operation unit to perform horizontal hold control has been hitherto well known.

By way of example, an invention in which the boom and arm of a wheel loader are linked by a linking mechanism and, the posture of the bucket is held horizontal by the actuation of the bucket at a constant relationship established by the link mechanism in response to the actuation of the boom has been hitherto well known.

However, according to this invention, a special link mechanism must be manufactured in accordance with the type of work device. In addition, the link mechanism cannot be installed easily in existing construction machine and new work devices must be manufactured. For this reason, there are problems in that this lacks versatility.

In addition, Japanese Patent Application Laid-Open No. 10-219730 describes an invention in which return pressured oil discharged from a boom hydraulic cylinder is, in such a way that the posture of the bucket is held horizontal, branched by a branching valve to be supplied to a bucket hydraulic cylinder.

However, the abovementioned branching valve must be provided between an operation valve and the hydraulic cylinder. For this reason, the laying of the pressured oil conduits is complicated. In addition, a problem arises in that the hydraulic apparatus, through which a large flow rate of pressured oil of high pressure passes, is of large scale. In addition, because the flow rate which drives the actuator is branched, changes in the flow rate are dependent on the load. For this reason the operator must, to maintain the horizontal posture, be constantly carrying out minute operations. In other words, there are the problems that, because control is difficult, the burden on the operator is large and experience is required.

SUMMARY OF THE INVENTION

Thereupon, the present invention, which has excellent versatility, in which the pipe laying can be configured easily, in which the hydraulic apparatus can be compacted by the manipulation of pilot pressured oil, and in which no burden is placed on the operator, was designed to resolve these problems.

A first invention of the present inventions provides, in order to achieve the above-noted resolution of the problems, a hydraulic drive machine which comprises: a hydraulic pump (1), and at least two hydraulic actuators (2, 3) driven by supply of discharged pressured oil from the hydraulic pump (1); operation means (4, 5) provided correspondent with the hydraulic actuators (2, 3); and operation valves (6, 7) connected between each of the operation means and each of its correspondent hydraulic actuator which respectively change opening amounts thereof in accordance with operating amounts of the operation means (4, 5), and which supply pressured oil to the hydraulic actuators (2, 3) correspondent with the operation means (4, 5), at a flow rate according to the respective opening amounts, wherein the machine comprises front-to-rear differential pressure constant means (8, 9) connected between the hydraulic pump and each of the operational valves which equalize a difference in pressure between a pressure of pressured oil on an upstream side and a pressure of pressured oil on a downstream side of the operation valves (6, 7) respectively, and wherein when one of the operation means (4) of the operation means (4, 5) is operated, by changing the opening amount of the other operation valve (7) correspondent with the other operation means (5) in accordance with the operation amount of the operation means (4), the other hydraulic actuator (3) correspondent with the other operation valve (7) is driven.

A description of the first invention is given below with reference to FIG. 1 and FIG. 3.

Based on the general formula for a hydraulic circuit, the following formula (1) is established, when Q is the flow rate which passes through the diaphragm of the operation valve, c is the flow rate coefficient, A is the opening surface area of the diaphragm, and ΔP is the front-to-rear differential pressure of the diaphragm $$Q=c\cdot A\cdot\sqrt{\Delta P}) \tag{1}$$

Here, by constantly making the differential pressure ΔP identical, a flow rate is obtained which is proportional to a drive command value (opening surface area A) issued by the operator.

According to the first invention, the differential pressure ΔP between the pressure of the pressured oil on the upstream side and the pressure of the pressured oil on the downstream side of the operation valves 6, 7 is equalized by the front-to-rear differential pressure constant means 8, 9. As a result, from the above-noted formula (1), the flow rates Q1, Q2 of the operation valves 6, 7 are, irrespective of load fluctuations, determined univocally in accordance with the opening surface areas (opening amounts) A1, A2 of the operation valves 6, 7.

When one of the operation means 4, 5, the operation means 4 for example is operated, the opening amount A2 of the other operation valve 7 correspondent with the other operation means 5 is altered in accordance with the operation amount S1 of said operation means 4, and the other hydraulic cylinder 3 correspondent with said other operation valve 7 is driven.

That is to say, the ratio of the opening amount A1 of the operation valve 6 and the opening amount A2 of the operation valve 7 with respect to the operation amount S1 of the one operation means 4 is, as shown in FIG. 3(*b*), set to a constant relationship (b:a). For this reason, the ratio of the flow rate Q1 supplied to the hydraulic cylinder 2 correspondent with the operation valve 6, and the flow rate Q2 supplied to the hydraulic cylinder 3 correspondent with the operation valve 7, form the above-noted constant relationship (b:a).

According to the first invention as described above, by way of example, a boom hydraulic cylinder 2 and bucket hydraulic cylinder 3 can be simultaneously driven at a constant flow rate ratio by the operation of the boom operation unit 4 only.

In this case, since the ratio of the opening amount A1 of the operation valve 6 and the opening amount A2 of the operation valve 7 with respect to the operation amount S1 of the operation means 4 only needs to be set to a constant relationship, the device configuration, such as the laying of the pressured oil conduits, is simple. That is to say, for example, a shuttle valve 50 and a pilot conduit 18*b* only should be newly provided such that a pilot pressure P in accordance with the operation amount S1 can be supplied to the operation valves 6, 7. In addition, the operation valves 6, 7 (the spool) should be configured in such a way that the ratio of the opening amounts A1, A2 of the operation valves 6, 7 form a constant relationship.

In addition, according to the first invention, the shuttle valve 50 and the pilot conduit 18*b* only are newly provided, and the operation valves 6, 7 (the spool thereof) only needs to be configured such that the ratio of the opening amount A2 of the operation valve 7 and the opening amount A1 of the operation valve 6 with respect to the operation amount S1 of the boom operation unit 4 is set to a constant relationship. For this reason, it can be easily installed in existing hydraulic circuits.

In addition, according to the first invention, the pilot pressured oil of low pressure and small flow rate is used, so the hydraulic apparatus can be compacted.

As a result, according to the first invention, high versatility can be obtained, the pipe laying can be configured easily and, by virtue of the fact that the pilot pressured oil is managed, the hydraulic apparatus can be compacted.

In addition a second invention provides a hydraulic drive machine which comprises: a hydraulic pump (1), and a boom hydraulic actuator (2) and a bucket hydraulic actuator (3) driven by supply of discharged pressured oil from the hydraulic pump (1); a boom (10) and a bucket (11) operated in accordance with the drive of the boom hydraulic actuator (2) and the bucket hydraulic actuator (3) respectively; boom operation means (4) and bucket operation means (5) provided correspondent with the boom hydraulic actuator (2) and the bucket hydraulic actuator (3) respectively; and a boom operation valve (6) and a bucket operation valve (7) which change opening amounts thereof in accordance with operating amounts of the boom operation means (4) and the bucket operation means (5), and which supply pressured oil to the boom hydraulic actuator (2) and the bucket hydraulic actuator (3) respectively, at a flow rate in accordance with the respective opening amounts, wherein the machine comprises: front-to-rear differential pressure constant means (8, 9) connected between the hydraulic pump and each of the operational valves which equalize a difference in pressure between a pressure of pressured oil on an upstream side and a pressure of pressured oil on a downstream side of the boom operation valve (6) and the bucket operation valve (7) respectively; and, control means (50, 49) which, when the boom operation means (4) is operated, changes an opening amount of the bucket operation valve (7) in response to the operation amount of the boom operation means (4) in such a way that a posture of the bucket (11) is held constant.

A description of the second invention is given below with reference to FIG. 1 and FIG. 3.

According to the second invention, the differential pressure ΔP between the pressure of the pressured oil on the upstream side and the pressure of the pressured oil on the downstream side of the operation valves 6, 7 is made identical by the front-to-rear differential pressure constant means 8, 9. As a result, from the above-noted formula (1)($Q=c\cdot A\cdot\sqrt{(\Delta P)}$), the flow rates Q1, Q2 of the operation valves 6, 7 are determined univocally, irrespective of load fluctuations, that is to say, fluctuations in ΔP, in accordance with the opening surface areas (opening amounts) A1, A2 of the operation valves 6, 7.

When the boom operation means 4 is operated, the opening amount A2 of the bucket operation valve 7 alters in response to the operation amount S1 of the boom operation means 4 in such a way that the posture of the bucket 11 is held constant.

That is to say, the ratio of the opening amount A1 of the operation valve 6 and the opening amount A2 of the operation valve 7 with respect to the operation amount S1 of the boom operation means 4 is, as shown in FIG. 3(*b*), set to a fixed relationship (b:a). By virtue of this, the ratio of the flow rate Q1 supplied to the boom hydraulic cylinder 2 correspondent with the boom operation valve 6 and the flow rate Q2 supplied to the bucket hydraulic cylinder 3 correspondent with the bucket operation valve 7 is the above-noted constant relationship (b:a). As a result, the posture of the bucket 11 is held constant.

According to the second invention, as described above, the bucket hydraulic cylinder 3 and the boom hydraulic cylinder 2 can be simultaneously driven at a constant flow rate ratio by only the operation of the boom operation means 4, and the posture of the bucket 11 can be set constant.

In this case, since the ratio of the opening amount A1 of the boom operation valve 6 and the opening amount A2 of the bucket operation valve 7 with respect to the operation amount S1 of the boom operation means 4 only needs to be set to a constant relationship, the device configuration such as the laying of the pressured oil conduits is simple. That is to say, for example, a shuttle valve 50 and a pilot conduit 18*b* only should be newly provided such that the pilot pressure P can be supplied to the operation valves 6, 7 in accordance with the operation amount S1. In addition, the operation valves 6, 7 (the spool thereof) should be configured in such a way that the ratio of the opening amounts A1, A2 of the operation valves 6, 7 form a constant relationship.

In addition, according to the second invention, the shuttle valve 50 and the pilot conduit 18*b* only should be newly provided, and the operation valves 6, 7 (the spool thereof) need only to be configured in such a way that the ratio of the A2 of the operation valve 7 and the opening amount A1 of the operation valve 6 with respect to the operation amount S1 of the boom operation means 4 is set to a constant relationship. For this reason, it can be installed easily in existing hydraulic circuits.

In addition, according to the second invention, since the pilot pressured oil, of low pressure and small flow rate, is used, the hydraulic apparatus can be compacted.

As a result, according to the second invention, a high versatility can be obtained, the pipe laying can be configured easily and, by the management of the pilot pressured oil, the hydraulic apparatus can be compacted.

In addition, a third invention is characterized in that, in the second invention the control means (50, 49), when a boom operation signal is output from the boom operation means (4) to afford a lift operation of the boom (10), generates a bucket operation signal which affords the actuation of the bucket (11) in a dumping direction in response to the boom operation signal, and changes the opening amount of the bucket operation valve (7) in response to the bucket operation signal.

A description of the third invention is given below with reference to FIG. 1.

According to the third invention, when a boom operation signal is emitted from the abovementioned boom operation means 4 to afford the lift operation of the abovementioned boom 10, a bucket operation signal is generated which affords the actuation of the abovementioned bucket 11 in the dumping direction in response to said boom operation signal, and the opening amount A2 of the abovementioned bucket operation valve 7 is altered in accordance with said bucket operation signal.

According to the third invention, automatic actuation in the dumping direction to the bucket 11 is performed by the operation of the boom operation means 4 in such a way that the boom 10 is lift-actuated, whereby the posture of the bucket 11 can be held constant.

In addition, the fourth invention is characterized in that, in the second invention, stroke stoppage detection means (35) which is connected to the boom operation valve and detects the stroke stoppage of the boom hydraulic actuator (2) is further provided, and wherein, when the stroke stoppage of the hydraulic actuator (2) has been detected by the stroke stoppage detection means (35), the control by the control means (50, 49) is turned off.

A description is given below of the fourth invention with reference to FIG. 2.

According to the fourth invention, when the stroke stoppage of the boom hydraulic cylinder 2 has been detected by the stroke stoppage detection means 35, and when control is performed by the control means 50, 49, in other words, the boom operation means 4 has been operated, the control which alters the opening amount A2 of the bucket operation valve 7 in response to the operation amount S1 of the boom operation means 4 is switched OFF in such a way that the posture of the bucket 11 is held constant.

According to the fourth invention, the same effects as the second invention are obtained.

Further according to the fourth invention, it can be prevented that the posture of the bucket 11 is not held constant by the continued supply of the pressured oil to the bucket hydraulic cylinder 3 following the stroke stoppage of the boom hydraulic cylinder 2.

That is to say, the control by the control means 50, 49 constitutes a control whereby a flow rate of pressured oil, in accordance with the operation amount S1, is supplied to the boom hydraulic cylinder 2 and bucket hydraulic cylinder 3 in response to the operation of the boom operation means 4. For this reason, even following the stroke stoppage of the boom hydraulic cylinder 2 and the stoppage of the operation of the boom 10, as long as the boom operation means 4 is operated, the supply of the flow rate of pressured oil to the bucket hydraulic cylinder 3 in accordance with the operation amount S1 thereof will be continued and the bucket 11 will continue to be actuated. For this reason, the posture of the bucket 11 will not remain constant.

Thereupon, in the fourth invention, when the stroke stoppage of the boom hydraulic cylinder 2 is detected by the stroke stoppage detection means 35, the supply to the bucket hydraulic cylinder 3 of the pressured oil at a flow rate in accordance with the operation amount S1 of the boom operation means 4, is stopped. More specifically, a flow rate of pressured oil, in accordance with the operation amount S2 of the bucket operation means 5, is supplied to the bucket hydraulic cylinder 3. For this reason, as soon as the operation of the boom 10 is stopped, the actuation of the bucket 11 becomes dependent on the operation amount S2 of the bucket operation means 5. By virtue of this, when the operation amount S2 of the bucket operation means 5 is 0, the posture of the bucket 11 is held constant.

In addition, a fifth invention is characterized in that, in the second invention, it further comprises exhaust flow rate control means (39) that is connected to the bucket operation valve for controlling a flow rate of pressured oil exhausted from the bucket hydraulic actuator (3) in response to a pressure of pressured oil supplied to the bucket hydraulic actuator (3), in such a way that a posture of the bucket is held constant.

A description is given below of the fifth invention with reference to FIG. 2.

According to the fifth invention, the same effects as the second invention are obtained.

Further, according to the fifth invention, the actuation of the bucket 11 by its own weight and displacement from the constant posture of the bucket 11 can be prevented.

That is to say, when the bucket 11 is actuated by its own weight and not by the pressured oil supplied from the hydraulic pump 1, displacement of the constant posture of the bucket 11 occurs.

Therefore, according to the fifth invention, if the pressured oil from the hydraulic pump 1 is supplied to the bucket hydraulic cylinder 3 and the pressure of the pressured oil is above a constant value, the flow rate of the pressured oil exhausted from the bucket hydraulic cylinder 3 is, without control, exhausted to a tank 23. In addition, when the pressured oil from the hydraulic pump 1 is not supplied to the bucket hydraulic cylinder 3 and the pressure of the pressured oil exceeds a constant value, the flow rate of the pressured oil exhausted from the bucket hydraulic cylinder 3 is controlled. By virtue of this, the actuation of the bucket 11 by its own weight is prevented. As a result, the actuation by its own weight and displacement from the constant posture of the bucket 11 is prevented.

DETAILED DESCRIPTION OF THE PREFERRED EMBODIMENTS

A description of an embodiment of the actuator control device and bucket posture control device pertaining to the present invention is given below with reference to the diagrams.

It will be noted that the embodiments hypothesize a hydraulic circuit mounted in construction machine such as a wheel loader or skid stair loader. In such construction machines a boom and bucket are provided as the work devices.

Figure 1:
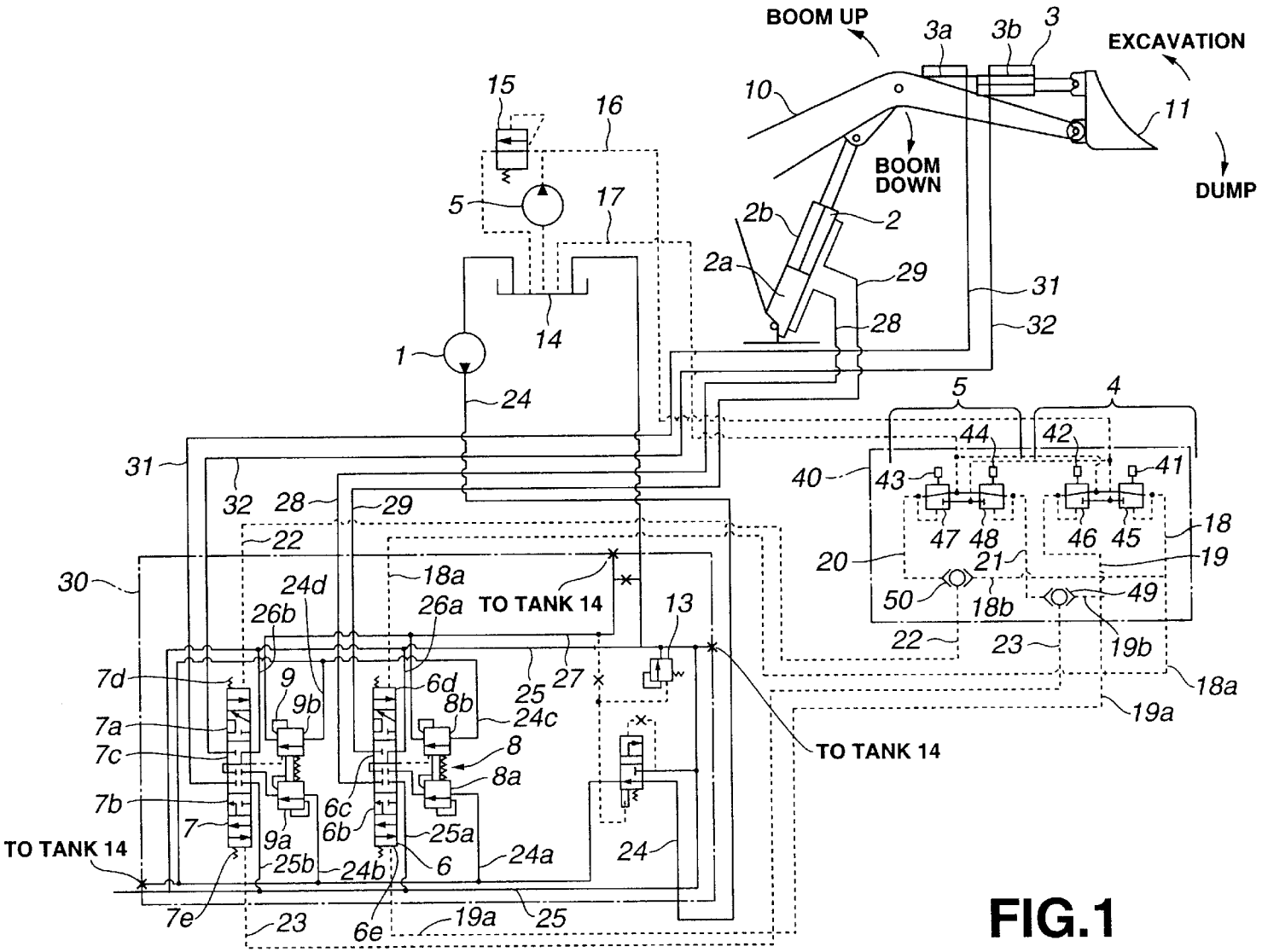
FIG. 1 is a hydraulic circuit diagram of a first embodiment.

FIG. 1 shows the hydraulic circuit of a first embodiment.

The main hydraulic pump 1 shown in FIG. 1, which is driven by an engine not shown in the diagram, discharges pressured oil. The discharged pressured oil is supplied to an operation valve unit 30 by way of a conduit 24. In addition, a pilot hydraulic pump 5, which is driven by the abovementioned engine, discharges pilot pressured oil. The pilot pressured oil is supplied to an operation lever device 40 by way of a conduit 16. A relief valve 15, which controls the pressure of the pilot pressured oil discharged into the conduit 16 from the pilot pressured oil pump 2 so it is less than a set relief pressure, is connected to the conduit 16. The return pressured oil is exhausted to a tank 14.

The pressured oil of pilot pressure P, in accordance with an operation amount S1 of a boom operation means 4, and the pressured oil of pilot pressure P, in accordance with an operation amount S2 of a bucket operation means 5, are output from the operation lever device 40.

A boom operation valve 6, correspondent with the boom operation means 4, is provided in the operation valve unit 30. In addition, a bucket operation valve 7 is provided correspondent with the bucket operation means 5.

A boom hydraulic cylinder 2 and a bucket hydraulic cylinder 3 are respectively driven by the supply of the discharged pressured oil of the main hydraulic pump 1 by way of a boom operation valve 6 and a bucket operation valve 7. A rod of the boom hydraulic cylinder 2 and a rod of the bucket hydraulic cylinder 3 are respectively connected to a boom 10 and bucket 11. The bucket 11 is interlocked to the boom 10.

The boom hydraulic cylinder 2 comprises a bottom chamber 2*a* and a head chamber 2*b*. When the pressured oil is supplied from the boom operation valve 6 by way of a conduit 28 to the bottom chamber 2*a* of the boom hydraulic cylinder 2, the rod of the boom hydraulic cylinder 2 is extended and the boom 10 is actuated to the lifting side. In addition, when the pressured oil is supplied from the boom operation valve 6 by way of a conduit 29 to the head chamber 2*b* of the boom hydraulic cylinder 2, the rod of the boom hydraulic cylinder 2 is retracted and the boom 10 is actuated to the lower side.

The bucket hydraulic cylinder 3 comprises a bottom chamber 3*a* and head chamber 3*b*. When the pressured oil is supplied from the bucket operation valve 7 by way of a conduit 31 to the bottom chamber 3*a* of the bucket hydraulic cylinder 3, the rod of the bucket hydraulic cylinder 3 is extended and the bucket 11 is actuated to the dump side. In addition, when the pressured oil is supplied from the bucket operation valve 7 by way of a conduit 32 to the head chamber 3*b* of the bucket hydraulic cylinder 3, the rod of the bucket hydraulic cylinder 3 is retracted and the bucket 11 is actuated to the excavation side.

Pressure compensation valves 8, 9 are provided in the operation valve unit 30 for each operation valve 6, 7.

The pressure compensation valve 8 is provided, from the perspective of the main hydraulic pump 1, in the upstream side of the boom operation valve 6, in other words, on a pressured oil supply channel between the main hydraulic pump 1 and the boom operation valve 6. In the same way, the pressure compensation valve 9 is provided, from the perspective of the main hydraulic pump 1, in the upstream side of the bucket operation valve 7, in other words, on a pressured oil supply channel between the main hydraulic pump 1 and the bucket operation valve 7.

The pressure compensation valves 8, 9 are valves which equalize the difference in pressure between the pressure of the pressured oil on the downstream side and the pressure of the pressured oil on the upstream side of the operation valves 6, 7. As is deduced from the above-noted formula (1) ($Q=c\cdot A\cdot\sqrt{(\Delta P)}$), which constitutes a general formula for a hydraulic circuit, by the equalizing of the differential pressure $\Delta P$, a flow rate Q1 is obtained which is proportionate to the operation amount S1 (opening surface area A1 of the operation valve 6) of the operation unit 4 operated by the operator and which bears no relationship to the magnitude of the load. In the same way, a flow rate Q2 is obtained which is proportionate to the operation amount S2 (opening surface area A2 of the operation valve 7) of the operation unit 5 and which bears no relationship to the magnitude of the load.

A more detailed description of the configuration of the operation lever device 40 is given below.

A piston 41, correspondent to the direction of the boom lifting operation of the boom operation unit 4, is provided in the operation lever device 40, and a pressure-reducing valve 45 is provided correspondent to the piston 41. In addition, a piston 42 is provided correspondent to the direction of boom lowering operation of the boom operation unit 4, and a pressure-reducing valve 46 is provided correspondent to the piston 42. In the same way, a piston 43 is provided correspondent to the dump side operation direction of the bucket operation unit 5, and a pressure-reducing valve 47 is provided correspondent to the piston 43. In addition, a piston 44 is provided correspondent to the bucket side operation direction of the bucket operation unit 5, and a pressure-reducing valve 48 is provided correspondent to the piston 44.

By the pushdown of the pistons 41, 42, 43 and 44 respectively, the set pressure of the pressure-reducing valves 45, 46, 47 and 48 are enlarged.

The inlet ports of the pressure-reducing valves 45~48 are respectively connected to a pilot hydraulic pump 5 by way of a conduit 16. In addition, the inlet ports of the pressure-reducing valves 45~48 are respectively connected to the tank 14 by way of a conduit 17.

The outlet ports of the pressure-reducing valves 45, 46, 47, 48 are respectively through connected to the pilot conduits 18, 19, 20 and 21.

Shuttles valves 49, 50 are provided in the operation lever device 40.

The pilot conduit 18 is branched into a pilot conduit 18*a* and pilot conduit 118*b*. In addition, the pilot conduit 19 is branched into a pilot conduit 1 9*a* and pilot conduit l9*b*.

The pilot conduit 18*b* and the pilot conduit 20 have through-connection to the inlet ports of the shuttle valve 50. The outlet port of the shuttle valve 50 has through-connection to the pilot conduit 22. In the same way, the pilot conduit 19*b* and pilot conduit 21 have through-connection to the inlet ports of the shuttle valve 49. The outlet port of the shuttle valve 49 has through-connection to the pilot conduit 23.

As noted above, the pilot pressured oil is supplied to the operation valve unit 30 from the operation lever device 40 by way of the pilot conduits 18*a,* 19*a,* 22 and 23.

Next, a description will be given of the working of the above-noted operation lever device 40.

When the boom operation unit 4 is operated to the boom lifting side the piston 41 is pushed down in accordance with the operation amount S1 and, the pilot pressured oil of pressure P, of a magnitude in accordance with the operation amount S1, is output to the pilot conduit 18 from the pressure-reducing valve 45.

In the same way, when the boom operation unit 4 is operated to the boom lowering side, the piston 42 is pushed down in accordance with the operation amount S1, and the pilot pressured oil of pressure P, of a magnitude in accordance with the operation amount S1, is output from the pressure-reducing valve 46 to the pilot conduit 19.

In the same way, when the bucket operation unit 5 is operated to the dump side, the piston 43 is pushed down in accordance with the operation amount S2, and the pilot pressured oil of pressure P, of a magnitude in accordance with the operation amount S2, is output from the pressure-reducing valve 47 to the pilot conduit 20.

In the same way, when the bucket operation unit 5 is operated to the excavation side, the piston 44 is pushed down in accordance with the operation amount S2, and the pilot pressured oil of pressure P, of a magnitude in accordance with the operation amount S2, is output from the pressure-reducing valve 48 to the pilot conduit 21.

For this reason, the larger of the pilot pressures P from amongst the pilot pressured oils of pilot pressure P correspondent to the boom lifting side operation amount S1 of the boom operation unit 4, and of pilot pressure P correspondent to the dump side operation amount S2 of the bucket operation unit 5, is output from the outlet port of the shuttle valve 50 to the pilot conduit 22 and supplied to the operation valve unit 30.

In the same way, the larger of the pilot pressures P from amongst the pilot pressured oils of pilot pressure P correspondent to the boom lowering side operation amount S1 of the boom operation unit 4, and the pilot pressure P correspondent to the excavation side operation amount S2 of the bucket operation unit 5, is output from the outlet port of the shuttle valve 49 to the pilot conduit 23 and supplied to the operation valve unit 30.

The pilot pressured oil of pilot pressure P correspondent to the boom lifting operation amount S1 of the boom operation unit 4 is output to the pilot conduit 18*a* to be supplied to the operation valve unit 30. In addition, the pilot pressured oil of pilot pressure P correspondent to the boom lowering operation valve S1 of the boom operation unit 4 is output to the pilot conduit 19*a* to be supplied to the operation valve unit 30.

Next, a detailed description of the configuration of the operation valve unit 30 will be given.

The boom operation valve 6 is a control valve which controls the direction and flow rate of the pressured oil discharged from the main hydraulic pump 1 and supplied to the boom hydraulic cylinder 2.

That is to say, the pressured oil discharged from the main hydraulic pump 1 flows into the boom operation valve 6 by way of a conduit 24 and a branched conduit 24*a* thereof. The pressured oil which has flowed out of the boom operation valve 6 is supplied to the boom hydraulic cylinder 2 by way of conduits 28 or 29.

The pilot conduits 18*a* and 19*a* are respectively connected to a boom ascend side port 6*d* and a boom descend side port 6*e* of the boom operation valve 6. The boom operation valve 6 comprises the 3 valve positions 6*c* (neutral position), 6*a* (boom lifting position), and 6*b* (boom lowering position). It will be noted that the valve position of the boom operation valve 6 continually changes, and the opening surface area also continually changes. The opening surface area at the neutral position is 0. When the pilot pressured oil is supplied to the boom ascend side port 6*d* of the boom operation valve 6 by way of the pilot conduit 18*a,* the opening surface area (opening amount) of the boom operation valve 6 changes, becoming A1, in response to the pilot pressure P, and the boom operation valve 6 is positioned in the boom lifting position 6*a*. By virtue of this, the pressured oil of flow rate Q1 is, in accordance with the opening surface area A1, supplied by way of the conduit 28 and boom operation valve 6 to the bottom chamber 2*a* of the boom hydraulic cylinder 2. As a result, the boom 10 is actuated to the lifting side.

In addition, when the pilot pressured oil is supplied to the boom descend side port 6*e* of the boom operation valve 6 by way of the pilot conduit 19*a,* the opening surface area (opening amount) A1 of the boom operation valve 6 changes in response to the pilot pressure P, and the boom operation valve 6 is positioned in the boom lowering position 6*b* side. By virtue of this, the pressured oil of flow rate Q1, in accordance with the opening surface area A1, is supplied by way of the conduit 29 to the head chamber 2*b* of the boom hydraulic cylinder 2. As a result, the boom 10 is actuated to the lowering side.

The return pressured oil from the boom operation valve 6 is discharged to the tank 14 by way of conduits 25*a* or 26*a,* and conduit 25.

In the same way, the flow rate and direction of the pressured oil output from the main hydraulic pump 1 is controlled by the bucket operation valve 7, whereby the controlled pressured oil is supplied to the bucket hydraulic cylinder 3.

That is to say, the pressured oil output from the main pressured oil pump 1 is led to the bucket operation valve 7 by way of the conduit 24 and a branching conduit 24*b* thereof. The pressured oil output from the bucket operation valve 7 is supplied to the bucket hydraulic cylinder 3 by way of conduits 31 or 32.

The pilot conduits 22, 23 are respectively connected to a bucket dump side port 7*d* and a bucket excavation side port 7*e* of the bucket operation valve 7. The bucket operation valve 7 comprises three valve positions 7*c* (neutral position), 7*a* (bucket dump position) and 7*b* (bucket excavation position). It will be noted that the valve position of the bucket operation valve 7 continually changes, and the opening surface area also continually changes. The opening surface area at the neutral position is 0. When the pilot pressured oil is supplied to the bucket dump side port 7*d* of the bucket operation valve 7 by way of the pilot conduit 22, the opening surface area (opening amount) A2 of the bucket operation valve 7 changes in response to the pilot pressure P, and the bucket operation valve 7 is positioned in the bucket dump position 7*a* side. By virtue of this, the pressured oil of flow rate Q2, in accordance with the opening surface area A2, is supplied to the bottom chamber 3*a* of the bucket hydraulic cylinder 3 by way of the bucket operation valve 7 and a conduit 31. As a result, the bucket 11 is actuated to the dump side.

In addition, when the pilot pressured oil is supplied to a bucket excavation side port 7*e* of the bucket operation valve 7 by way of the pilot conduit 23, the opening surface area (opening amount) A2 of the bucket operation valve 7 changes in response to the pilot pressure P, and the bucket operation valve 7 is positioned in the bucket excavation position 7*b* side. By virtue of this, the pressured oil of flow rate Q2, in accordance with the opening surface area A2, is supplied to the head chamber 3*b* of the bucket hydraulic cylinder 3 by way of the bucket operation valve 7 and conduit 32. As a result, the bucket 11 is actuated to the excavation side.

The return pressured oil from the bucket operation valve 7 is exhausted to the tank 14 by way of the conduit 25*b* or 26*b,* and conduit 25.

The pressure compensation valve 8 correspondent with the boom operation valve 6 is composed of a flow rate control valve unit 8*a* and pressure-reducing valve unit 8*b*. The pressured oil discharged from the main hydraulic pump 1 flows into the control valve unit 8*a* by way of the conduit 24 and the branching conduit 24*a* thereof The pressured oil discharged from the main hydraulic pump 1 flows into the pressure-reducing valve unit 8*b* by way of the conduit 24 and the branching conduit 24*c* thereof.

Similarly, the pressure compensation valve 9 correspondent with the bucket operation valve 7 is composed of a flow rate control valve unit 9*a* and a pressure-reducing valve unit 9*b*. The pressured oil discharged from the main hydraulic pump 1 flows into the flow rate control valve unit 9*a* by way of the conduit 24 and the branching conduit 24*b* thereof. The pressured oil discharged from the main hydraulic pump 1 flows into the pressure-reducing valve unit 9*b* by way of the conduit 24 and a branching conduit 24*d* thereof.

A pressure in accordance with the maximum load pressure of the hydraulic cylinders 2, 3 is applied in the direction of closure of the pressure-reducing valve units 8*b,* 9*b,* by way of a conduit 27, on the pressure-reducing valve units 8*b,* 9*b*.

For this reason, the front-to-rear differential pressure ΔP of the operation valves 6, 7 is made the same and constant, by the operation of the pressure compensation valves 8, 9. By virtue of this, the flow rates Q1, Q2 are established by the opening surface area A1, A2 of the operation valves 6, 7 unrelated to the magnitude of the load of the hydraulic cylinders 2, 3. In other words, from the above-noted formula (1) ($Q=c\cdot A\cdot\sqrt{(\Delta P)}$), the flow rates Q1, Q2 of the operation valves 6, 7 are, irrespective of load fluctuations, determined univocally in accordance with the opening surface areas (opening amounts) A1, A2 of the operation valves 6, 7.

An unload valve 12 is provided on the conduit 24. In the unload valve 12, the differential pressure between the pressure of the discharged oil of the main pressure pump 1 and the pressure in response to the maximum load pressure of the hydraulic cylinders 2, 3 is, regardless of the fluctuations of the load of the hydraulic cylinders 2, 3, formed to a constant value in accordance with a set pressure of the unload valve 12.

The unload valve 12 is opened and closed by: the spring forces of a spring provided in the unload valve 12; a pressure in response to the maximum load pressure; and the output pressure of the main hydraulic pump 1. The unload valve 12 is operated to the closing side by the spring and the pressure in response to the maximum load pressure. The unload valve 12 is operated to the opening side by the discharged pressure of the main hydraulic pump 1. By virtue of this, the differential pressure between the discharged pressure of the main hydraulic pump 1 and the pressure in response to the maximum load pressure is made constant in accordance with the set pressure of the unload valve 12.

A relief valve 13 is provided in a conduit 27 in which there is action of a pressure in accordance with the maximum load pressure. By virtue of this, the upper limit of the pressure in response to the maximum load pressure is set. Accordingly, the upper limit of the discharged pressure of the main hydraulic pump 1 is established by way of the unload valve 12.

Furthermore, the boom operation valve 6 and bucket operation valve 7 are configured in such a way that, in the case when the same pilot pressure P has action on the pilot ports 6*d,* 7*d* (or 6*e,* 7*e*), the ratio of the opening surface areas A1, A2 forms a constant ratio (b:a). This constant ratio constitutes the ratio at which the posture of the bucket 11 can be held in the horizontal with respect to the ground surface. More specifically, the ratio of the opening surface areas A1, A2 can be formed to the above-noted constant ratio by the processing of the spool of the boom operation valve 6 and bucket operation valve 7.

A description is given below, with reference to FIG. 3, of the relationship between the operation amounts S1, S2 of the operation units 4, 5 and the opening surface areas A1, A2 of the operation valves 6, 7.

Figure 3A:
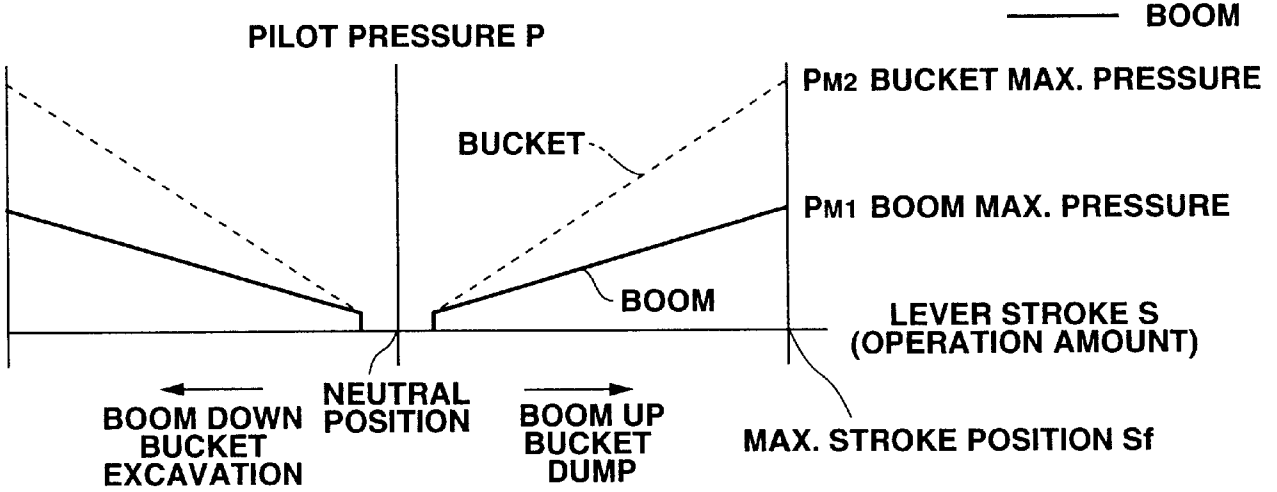
FIGS. 3(*a*) and (*b*) are diagrams which describe the relationship between the operation amount of the operation lever and the opening surface area of the operation valve.
Figure 3B:
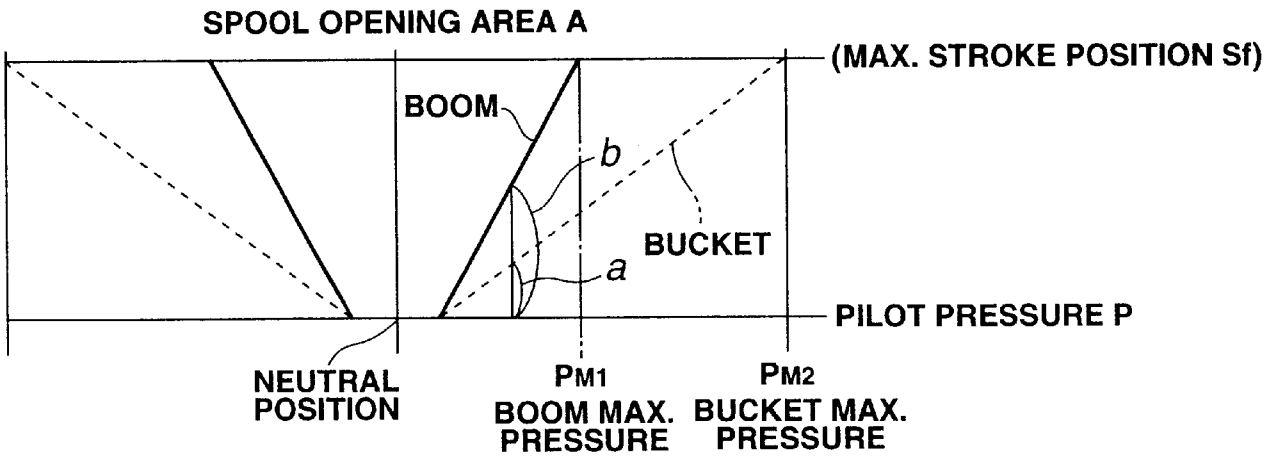

FIG. 3(*a*) shows the relationship between the lever stroke S1 of the boom operation unit 4 and lever stroke S2 of the bucket operation unit 5, and the pilot pressure P within the pilot conduits 18*a,* 19*a,* 20 and 21. The horizontal axis represents the lever stroke S (operation amount S), and the vertical axis represents the pilot pressure P. The characteristics of the boom operation unit 4 are shown by the solid line and the characteristics of the bucket operation unit 5 are shown by the broken line.

When the boom operation unit 4 is operated to the boom lifting side or the bucket operation unit 5 is operated to the dump side, the lever stroke S changes from the neutral position to the right direction in the diagram. As the lever stroke S increases, the pilot pressure P rises. At the point at which the lever stroke S reaches a maximum stroke position Sf, the pilot pressure P reaches a maximum pressure. The characteristics of the operation unit are set in such a way that a maximum pressure PM2, when the bucket operation unit 5 is operated to the dump side, is larger than a maximum pressure PM1, when the boom operation unit 4 is operated to the boom lifting side.

When the boom operation unit 4 is operated to the boom lowering side or the bucket operation unit 5 is operated to the excavation side, the lever stroke S changes from the neutral position to the left direction in the diagram. At identical characteristics, the pilot pressure P rises in response to the increase in the lever stroke S.

FIG. 3(*b*) shows the relationship between the opening surfaces areas A1, A2 of the boom operation valve 6 and bucket operation valve 7 and the pilot pressure P within the pilot conduits 18*a,* 19*a,* 22 and 23. The horizontal axis represents the pilot pressure P and the vertical axis represents the opening surface areas A. The characteristics of the boom operation valve 6 are shown by the solid line and the characteristics of the bucket operation valve 7 are shown by the broken line.

When the boom operation unit 4 is operated to the boom lifting side or the bucket operation unit 5 is operated to the dump side, the pilot pressure P changes from the neutral position to the right direction in the diagram. As the pilot pressure P increases, the surface area A rises. At the point at which pilot pressure P reaches a boom maximum pressure PM1, the surface area A1 of the boom operation valve 6 reaches a maximum opening surface area. At the point at which the pilot pressure P reaches a bucket maximum pressure PM2, the surface area A2 of the bucket operation valve 7 reaches a maximum opening surface area.

Here, the characteristics (the spool thereof) of the operation valve 6, 7 are set in such a way that the ratio of the surface area A2 of the bucket operation valve 7 and the surface area A1 of the boom operation valve 6 are, at the same pilot pressure P, when the boom maximum pressure is PM1 or lower, a constant ratio b:a.

On the other hand, when the boom operation unit 4 is operated to the boom lowering side or the bucket operation unit 5 is operated to the excavation side, the pilot pressure P changes from the neutral position to the left direction in the diagram. With the same operation valve characteristics, the opening surface area A rises in response to the increase in the pilot pressure P.

Next a description will be given of the operation of the hydraulic circuit of the first embodiment of FIG. 1.

Now, if it is assumed that the operator operates the boom operation unit 4 of the operation lever device 40 to the boom lifting side, the bucket operation unit 5 is not incline-operated from the neutral position.

For this reason, the pilot pressured oil of pilot pressure P is output to the pilot conduit 18*a* in accordance with the operation amount S1 of the boom operation unit 4. This pilot pressured oil is supplied to the boom ascend side port 6*d* of the boom operation valve 6 by way of the pilot conduit 18*a*.

In addition, the pilot pressured oil of pilot pressure P is output to the pilot conduit 18*b* in accordance with the operation amount S1 of the boom operation unit 4 and applied to one of the inlet ports of the shuttle valve 50. Now, since the bucket operation unit is in a neutral position, the pressure of the pilot conduit 20, in other words, the pressure of the other inlet port of the shuttle valve 50, constitutes the pressure within the tank 14. For this reason, the pilot pressured oil of pilot pressure P, in accordance with the operation amount S1 of the boom operation unit 4, is output to the pilot conduit 22 by way of the shuttle valve 50. The pilot pressured oil is supplied to the dump side port 7*d* of the bucket operation valve 7 by way of the pilot conduit 22.

For this reason, the boom operation valve 6, in response to the pilot pressure P applied to the operation valves 6 and 7, is positioned in the boom rise position 6*a* side, and the bucket operation valve 7 is positioned in the dump position 7*a* side. At this time, as the pilot pressure P increases, lifting is effected while the opening surface area A2 of the bucket operation valve 7 and the opening surface area A1 of the boom operation valve 6 maintain the constant ratio b:a as shown in FIG. 3(*b*). By virtue of this, lifting is effected while the ratio of the flow rate Q1 supplied to the bottom chamber 2*a* of the boom hydraulic cylinder 2 and the flow rate Q2 supplied to the bottom chamber 3 a of the bucket pressured oil cylinder 3 is maintained at the above-noted constant ration b:a. As a result, accompanying the actuation of the boom 10 to the lifting side, the bucket 11 is actuated to the dump side at a constant relationship, and the posture of the bucket 11 with respect to the ground surface is maintained at the horizontal.

On the other hand, when the operator operates the boom operation unit 4 of the operation lever device 40 to the boom lowering side, in the same way, horizontal control is performed on the bucket 11 to hold it in the horizontal. At this time, the bucket operation unit 5 is not incline-operated from the neutral position.

That is to say, the pilot pressured oil of pilot pressure P is output to the pilot conduit 19*a* in accordance with the operation amount S1 of the boom operation unit 4. This pilot pressured oil is supplied to the boom descend side port 6*e* of the boom operation valve 6 by way of the pilot conduit 19*a*.

In addition, the pilot pressured oil of pilot pressure P is output to the pilot conduit 19*b* in accordance with the operation amount S1 of the boom operation unit 4 and applied to one of the inlet ports of the shuttle valve 49. Now, since the bucket operation unit is in a neutral position, the pressure of the pilot conduit 21, in other words, the pressure of the other inlet port of the shuttle valve 49, constitutes the pressure within the tank 14. For this reason, the pilot pressured oil of pilot pressure P is output to the pilot conduit 23 by way of the shuttle valve 49 in accordance with the operation amount S1 of the boom operation unit 4. The pilot pressured oil is supplied to the excavation side port 7*e* of the bucket operation valve 7 by way of the pilot conduit 23.

For this reason, the boom operation valve 6, in response to the pilot pressure P applied to the operation valves 6 and 7, is positioned in the boom lowering position 6*b* side, and the bucket operation valve 7 is positioned in the excavation position 7*b* side. At this time, as the pilot pressure P increases, lifting is effected while the opening surface area A2 of the bucket operation valve 7 and the opening surface area A1 of the boom operation valve 6 maintain the constant ratio b:a as shown in FIG. 3(*b*). By virtue of this, lifting is effected while the ratio of the flow rate Q1 supplied to the head chamber 2*b* of the boom hydraulic cylinder 2 and the flow rate Q2 supplied to the head chamber 3*b* of the bucket pressured oil cylinder 3 is maintained at the above-noted constant ration b:a. As a result, accompanying the actuation of the boom 10 to the lowering side, the bucket 11 is actuated to the excavation side at a constant relationship, and the posture of the bucket 11 with respect to the ground surface is maintained at the horizontal.

As noted above, according to the present embodiment, the boom hydraulic cylinder 2 and bucket pressured oil cylinder 3 can be drive simultaneously at a constant flow rate ratio b:a by the simple operation of the boom operation unit 4, and the posture of the bucket 11 can be held in the horizontal.

In this case, all that is required is for the ratio of the opening amount A1 of the operation valve 6 and the opening amount A2 of the operation valve 7 with respect to the operation amount S1 of the boom operation unit 4 to be set to a constant relationship so, the device configuration, such as the pipe laying of the pressured oil conduits, is simple. That is to say, for example, the new provision of a shuttle valve 50, 49 and a pilot conduit 18*b*, 19*b* should be performed such that the pilot pressure P can be supplied to the operation valves 6, 7 in accordance with the operation amount S1. In addition, the operation valves 6, 7 (the spool) should be configured in such a way that the ratio of the opening amounts A1, A2 of the operation valves 6, 7 forms a constant relationship.

In addition, according to the present embodiment, all that is required is for the shuttle valve 50, 49 and the pilot conduit 18*b*, 19*b* to be provided, and for the operation valves 6, 7 (the spool) to be configured such that the ratio of the opening amount A2 of the bucket operation valve 7 and the opening amount A1 of the boom operation valve 6, with respect to the operation amount S1 of the boom operation unit 4, is set to a constant relationship. For this reason, it can be easily installed in existing hydraulic circuits.

In addition, according to the present embodiment, the pilot pressured oil of low pressure and small flow rate is used, so the hydraulic apparatus can be compacted.

As a result, based on the present embodiment, a high versatility can be obtained, the pipe laying can be configured easily and, by the management of the pilot pressured oil, the hydraulic apparatus can be compacted.

In addition, according to the present embodiment, as shown in FIG. 3, a bucket maximum pressure PM2 is set at a characteristic which is larger than a boom maximum pressure PM1.

For this reason, even if the boom operation unit 4 reaches the maximum stroke position Sf whereby the operation of the boom 10 is mechanically stopped, the bucket 11 can be operated in accordance with the operation amount S2 of the bucket operation unit 5 by the operation of the bucket operation unit 5.

That is to say, when the bucket operation unit 5 is operated to the dump side and a pilot pressured oil of pilot pressure P, which is larger than the boom maximum pressure PM1, is output to the pilot conduit 20, a pilot pressured oil of pilot pressure P is output to the pilot conduit 22 in accordance with the operation amount S2 of the bucket operation unit 5 by way of the shuttle valve 50. In addition, when the bucket operation unit is operated to the excavation side and a pilot pressured oil of pilot pressure P, which is larger than the boom maximum pressure PM1, is output to the pilot conduit 21, a pilot pressured oil of pilot pressure P is output to the pilot conduit 23 in accordance with the operation amount S2 of the bucket operation unit 5 by way of the shuttle valve 49. A pilot pressure P in accordance with the operation amount S2 of the bucket operation unit 5 is applied to the dump side port 7*d* or the excavation side port 7*e* of the bucket operation valve 7 by way of the pilot conduits 22 or 23, and the bucket 11 is actuated to the dump side or excavation side.

Incidentally, the control of the first embodiment constitutes a control whereby, a flow rate of pressured oil, in accordance with the operation amount S1 of the boom operation unit 4, is supplied to the boom hydraulic cylinder 2 and bucket hydraulic cylinder 3. For this reason, even following the stroke stoppage of the boom hydraulic cylinder 2 and the stoppage of the operation of the boom 10, as long as the boom operation unit 4 is operated, the supply of the flow rate of pressured oil to the bucket hydraulic cylinder 3 in accordance with the operation amount S1 thereof is continued, and the bucket 11 continues to be operated. For this reason, the posture of the bucket 11 is not held in the horizontal.

In addition, according the first embodiment, there is a fear that the bucket 11 will be actuated not by the pressured oil supplied from the main hydraulic pump 1 but by its own weight. For this reason, there is a fear that there will be displacement from the horizontal posture of the bucket 11.

Next, a description will be given of a second embodiment which can resolve these problems.

Figure 2:
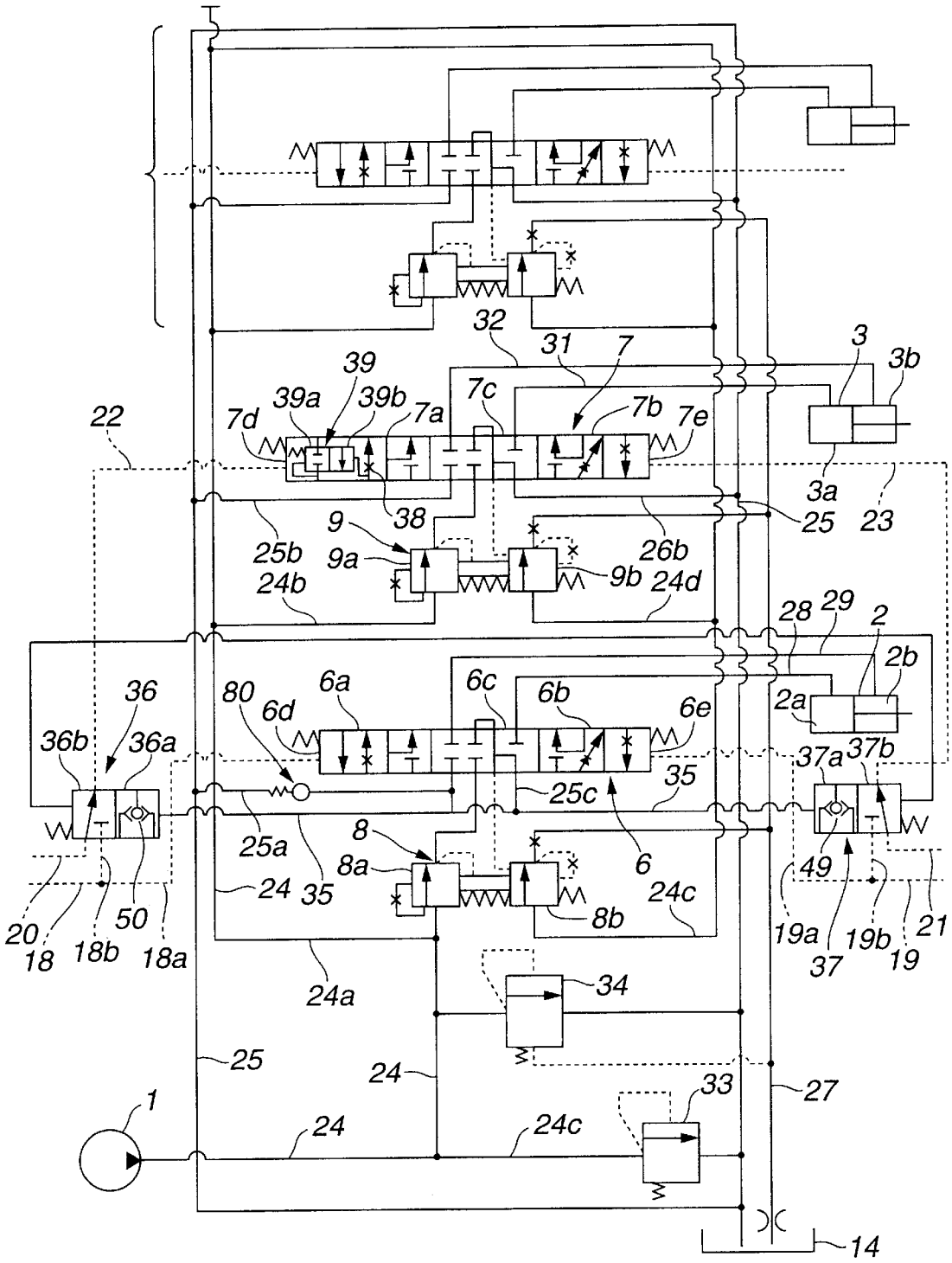
FIG. 2 is a hydraulic circuit diagram of a second embodiment.

FIG. 2 shows a hydraulic circuit of a second embodiment. The same reference symbols have been used for the elements which are common with FIG. 1, and a repetition of the description thereof has been omitted if appropriate.

As is shown in FIG. 2, a relief valve 33, which controls the pressure of the pressured oil discharged from the main hydraulic pump 1 to the conduit 24 at a set relief pressure or below, is connected to a branching conduit 24*e* of the conduit 24. In addition, an unload valve 34 is provided instead of the unload valve 12 of FIG. 1. It will be noted that, in the hydraulic circuit shown in FIG. 2, a supplementary circuit has been included in order to afford the actuation of an attachment.

A conduit 25*a,* through which the return pressured oil from the head chamber 2*b* of the boom hydraulic cylinder 2 passes to be exhausted to the tank 14, is provided in the boom operation valve 6. In addition, a conduit 26*a,* through which the return pressured oil from the bottom chamber 2*a* of the boom hydraulic cylinder 2 passes to be discharged to the tank 14, is provided in the boom operation valve 6. The conduits 25*a,* 26*a* have through-connection to a boom return pressure signal generation conduit 35. A back pressure valve 25*a* is provided in the conduit 25*a.* For this reason, when the return pressured oil flows through the conduit 25*a* or 26*a* to the tank 14 side, the back pressure valve 80 is operated whereby the return pressured oil back pressure (this is referred to as the boom return pressure signal) is generated within the boom return pressure signal generation conduit 35.

In the present embodiment, a shuttle valve 50 is incorporated in a selector valve 36. The pilot conduit 18*b* and pilot conduit 20 are connected to a pressured oil flow inlet on the upstream side of the selector valve 36. A pilot conduit 22 is connected to the pressured oil flow outlet on the downstream side of the selector valve 36. The boom return pressure signal generation conduit 35 is connected to the side which opposes the side which a spring for the selector valve 36 is provided. The selector valve 36 comprises a valve position 36*a,* in which the pilot conduits 18*b* and 20 have through-connection to the pilot conduit 22 by way of the shuttle valve 50, and a valve position 36*b,* in which the pilot conduit 20 has through-connection to the pilot conduit 22.

When a boom return pressure signal is generated in the boom return pressure signal generation conduit 35, the boom return pressure signal is applied to the selector valve 36 whereby the selector valve 36 is switched over to the valve position 36*a.* For this reason, the pilot conduit 18*b* and pilot conduit 20 have through-connection with the inlet ports of the shuttle valve 50. In addition, the outlet ports of the shuttle valve 50 have through-connection with the pilot conduit 22. On the other hand, when a boom return pressure signal is not generated in the boom return pressure signal generation conduit 35, the selector valve 36 is switched over to the valve position 36*b* by the spring. For this reason, the pilot conduit 20 has through-connection with the pilot conduit 22.

In the same way as the selector valve 36, a selector valve 37, with a shuttle valve 49 built in, is provided. The pilot conduit 19*b* and pilot conduit 21 are connected to the pressured oil flow inlet on the upstream side of the selector valve 37. A pilot conduit 23 is connected to the pressured oil flow rate outlet on the downstream side of the selector valve 37. The above-noted boom return pressure signal generation conduit 35 is connected to the side which opposes the side in which the spring for the selector valve 37 is provided. The selector valve 37 comprises a valve position 37*a,* in which the pilot conduits 19*b* and 21 have through-connection to the pilot conduit 23 by way of the shuttle valve 49, and a valve position 37*b,* in which the pilot conduit 21 has through-connection to the pilot conduit 23.

When a boom return pressure signal is generated in the boom return pressure signal generation conduit 35, the selector valve 37 is switched over to the valve position 37*a* by the application of the boom return pressure signal on the selector valve 37 and the resistance to the spring. For this reason, the pilot conduit 19*b* and pilot conduit 21 have through-connection with the inlet ports of the shuttle valve 49. In addition, the outlet ports of the shuttle valve 49 have through-connection with the pilot conduit 23. On the other hand, when a boom return pressure signal is not generated in the boom return pressure signal generation conduit 35, the selector valve 37 is switched over to the valve position 37*b* by the spring forces. For this reason, the pilot conduit 21 has through-connection with the pilot conduit 23.

In the present embodiment, a counter-balance valve 39 is built into the valve position 7*d* of the dump side of the bucket operation valve 7. When the bucket operation valve 7 is positioned in the dump position 7*d,* the conduit 24*b* has through-connection to the conduit 31 by way of a diaphragm 38. The pressure on the upstream side of the diaphragm 38 is applied to the side opposing the side in which the spring for the counter-balance valve 39 is provided. The counter-balance valve 39 comprises a valve position 39*a,* which obstructs through-connection between the conduit 32 and conduit 25*b,* and a valve position 39*b,* which affords the through-connection between the conduit 32 and conduit 25*b.*

When the pressure of the conduit 24*b* exceeds a certain value, the counter-balance valve 39 is switched over to the valve position 39*b* by the application of the pressure on the upstream side of the diaphragm 38 on the counter-balance valve 39 and the resistance to the spring forces. For this reason, the return pressured oil from the conduit 32 is exhausted to the tank 14 by way of the conduit 25*b.* In addition, when the pressure of the conduit 24*b* is less than the above-noted set value, the counter-balance valve 39 is switched over to the valve position 39*a* by the spring forces. For this reason, the return pressured oil from the conduit 32 is obstructed and the exhausted amount of return pressured oil to the tank 14 is controlled.

Next, a description will be given of the operation of the hydraulic circuit of the second embodiment.

Now, it is assumed that the operator operates the boom operation unit 4 of the operation lever device 40 to the boom lifting side and, at this time, the bucket operation unit 5 is not incline-operated from the neutral position.

For this reason, the pilot pressured oil of pilot pressure P is output to the pilot conduit 18*a* in accordance with the operation amount S1 of the boom operation unit 4. This pilot pressured oil is supplied to the boom ascend side port 6*d* of the boom operation valve 6 by way of the pilot conduit 18*a.* As a result, the pressured oil is supplied from the boom operation valve 6 to the bottom chamber 2*a* of the boom hydraulic cylinder 2 by way of the conduit 28. In addition the return pressured oil from the head chamber 2*b* of the boom hydraulic cylinder 2 is caused to flow into the boom return pressure signal generation conduit 35 and conduit 25*a* by way of the boom operation valve 6 and conduit 29.

The pilot pressured oil of pilot pressure P is output to the pilot conduit 18*b* in accordance with the operation amount S1 of the boom operation unit 4. Now, since the bucket operation unit 5 is in a neutral position, the pressure of the pilot conduit 20 constitutes the pressure within the tank 14.

When the boom operation unit 4 has not reached the maximum stroke position Sf, the return pressured oil from the head chamber 2*b* of the boom hydraulic cylinder 2 flows into the conduit 25*a* and boom return pressure signal generation conduit 35. For this reason, a boom return pressure signal is generated in the boom return pressure signal generation conduit 35. The boom return pressure signal is applied to the selector valve 36 and the selector valve 36 is switched over to the valve position 36*a.* For this reason, the pilot conduit 18*b* and pilot conduit 20 have through-connection to the inlet ports of the shuttle valve 50. In addition, the outlet port of the shuttle valve 50 is through connected to the pilot conduit 22.

For this reason, the pilot pressured oil of pilot pressure P is output to the pilot conduit 22 by way of the shuttle valve 50 in accordance with the operated amount S1 of the boom operation unit 4. The pilot pressured oil is supplied to the dump side port 7*d* of the bucket operation valve 7 by way of the pilot conduit 22. As a result, pressured oil is supplied from the boom operation valve 7 to the bottom chamber 3*a* of the bucket pressured oil cylinder 3 by way of the conduit 31. In addition, the return pressured oil from the head chamber 3*b* of the bucket pressured oil cylinder 3 flows into the bucket operation valve 7 by way of the conduit 32.

As a result, accompanying the operation of the boom 10 to the lifting side, the bucket 11 is actuated to the dump side at a constant relationship, and the piston of the bucket 11 is maintained horizontal with respect to the ground surface.

When the boom operation unit 4 reaches the maximum stroke position Sf and stroke stoppage of the rod of the boom hydraulic cylinder 2 occurs, the return pressured oil from the head chamber 2*b* of the boom hydraulic cylinder 2 stops flowing into the boom return pressure signal generation conduit 35 and conduit 25*a.* For this reason, the boom return pressure signal stops being generated in the boom return pressure signal generation conduit 35. For this reason, the selector valve 36 is switched to the valve position 36*b* and the pilot conduit 20 has through-connection to the pilot conduit 22.

As a result, the pilot pressure P in accordance with the operation amount S1 of the boom operation unit 4 is no longer applied to the boom operation valve 7. The bucket operation valve 7 forms a state in which work is possible in response to the operation of the bucket operation unit 5. The bucket operation unit 5 is in a neutral position so, the pilot pressure P is not applied to the boom operation valve 7. For this reason, at the point at which stroke stoppage of the boom hydraulic cylinder 2 occurs and the operation of the boom 10 is stopped, the supply of pressured oil to the bucket pressured oil cylinder 3 is stopped and the operation of the bucket 11 is stopped. By virtue of this, a state in which the posture of the bucket 11 does not remain in the horizontal is prevented by the continued supply of pressured oil to the bucket hydraulic cylinder 3 after the stroke stoppage of the boom hydraulic cylinder 2 has occurred.

In addition, in a state in which the bucket operation valve 7 is positioned in the dump position 7*d,* when the pressured oil is supplied from the main hydraulic pump 1 to the conduit 24*b,* the pressure within the conduit 24*b* is equivalent to the constant pressure or above. When the pressure on the upstream side of the diaphragm 38, which constitutes the constant pressure or above, is applied to the counter-balance valve 39, the counter-balance valve 39 is switched over to the valve position 39*b.* For this reason, the return pressured oil from the bucket pressured oil cylinder 3 is discharged to the tank 14 by way of the conduit 32 and conduit 25*b.* That is to say, when the supplied pressure to the bucket pressured oil cylinder 3 is the constant pressure or above, the exhausted amount of the return pressured oil from the bucket pressured oil cylinder 3 is not controlled.

In addition, when the pressure of the conduit 24*b* is less than the above-noted certain value, the counter-balance valve 39 is switched over to the valve position 39*a.* For this reason, the return pressured oil from the bucket pressured oil cylinder 3 is obstructed by the counter-balance valve 39 and the exhausted amount of the return pressured oil to the tank 14 is controlled. That is to say, when the supplied pressure to the bucket pressured oil cylinder 3 is less than the constant pressure, the exhausted amount of the return pressured oil from the bucket pressured oil cylinder 3 is controlled. By virtue of this, the actuation of the bucket 11 by its own weight is prevented. As a result, the actuation of the bucket 11 by its own weight and the displacement from the horizontal posture is prevented.

Next, a description will be given of a case in which the operator operates the boom operation unit 4 of the operation lever device 40 to the boom lowering side.

That is to say, the pilot pressured oil of pilot pressure P is output to the pilot conduit 19*a* in accordance with the operation amount S1 of the boom operation unit 4. This pilot pressured oil is supplied to the boom descend side port 6*e* of the boom operation valve 6 by way of the pilot conduit 19*a*. As a result, the pressured oil is supplied from the boom operation valve 6 to the head chamber 2*b* of the boom hydraulic cylinder 2 by way of the conduit 29. In addition the return pressured oil from the bottom chamber 2*a* of the boom hydraulic cylinder 2 is caused to flow into the boom return pressure signal generation conduit 35 and conduit 26*a* by way of the boom operation valve 6.

The pilot pressured oil of pilot pressure P is output to the pilot conduit 19*b* in accordance with the operation amount S1 of the boom operation unit 4. Now, since the bucket operation unit 5 is in a neutral position, the pressure of the pilot conduit 21 constitutes the pressure within the tank 14.

When the boom operation unit 4 does not reach the maximum stroke position Sf, the return pressured oil from the bottom chamber 2*a* of the boom hydraulic cylinder 2 flows into the boom return pressure signal generation conduit 35 and conduit 26*a*. For this reason, the boom return pressure signal is generated in the boom return pressure signal generation conduit 35. The boom return pressure signal is applied to the selector valve 37 and the selector valve 37 is switched to the valve position 37*a*. For this reason, the pilot conduit 19*b* and the pilot conduit 21 have through-connection to the inlet ports of the shuttle valve 49. In addition, the outlet port of the shuttle valve 49 has through-connection to the pilot conduit 23.

For this reason, the pilot pressured oil of pilot pressure P is output to the pilot conduit 23 by way of the shuttle valve 49 in accordance with the operation amount S1 of the boom operation unit 4. The pilot pressured oil is supplied to the excavation side port 7*e* of the bucket operation valve 7 by way of the pilot conduit 23. As a result, the pressured oil is supplied to the head chamber 3*b* of the bucket pressured oil cylinder 3 by way of the conduit 32 from the bucket operation valve 7. In addition, the return pressured oil from the bottom chamber 3*a* of the bucket pressured oil cylinder 3 is discharged to the tank 14 by way of the conduit 31 bucket operation valve 7 and conduit 26*b*.

As a result, accompanying the actuation of the boom 10 to the lowering side, the bucket 11 is actuated to the excavation side at a constant relationship, and the posture of the bucket 11 with respect to the ground surface is maintained at the horizontal.

When the boom operation unit 4 reaches the maximum stroke position Sf and stroke stoppage of the rod of the boom hydraulic cylinder 2 occurs, the return pressured oil from the bottom chamber 2*a* of the boom hydraulic cylinder 2 stops flowing into the boom return pressure signal generation conduit 35. and conduit 26*a*. For this reason, the boom return pressure signal stops being generated in the boom return pressure signal generation conduit 35. For this reason, the selector valve 37 is switched to the valve position 37*b* and the pilot conduit 21 has through-connection to the pilot conduit 23.

As a result, the pilot pressure P is no longer applied to the bucket operation valve 7 in accordance with the operation amount S1 of the boom operation unit 4. The bucket operation valve 7 assumes a state in which work is possible in response to the operation of the bucket operation unit 5. The bucket operation unit 5 is in a neutral position so the pilot pressure P is not applied to the bucket operation valve 7. For this reason, at the point at which stroke stoppage of the boom hydraulic cylinder 2 occurs and the operation of the boom 10 is stopped, the supply of pressured oil to the bucket pressured oil cylinder 3 is stopped and the operation of the bucket 11 is stopped. By virtue of this, a state in which the posture of the bucket 11 does not remain in the horizontal is prevented by the continual supply of pressured oil to the bucket hydraulic cylinder 3 following the stroke stoppage of the boom hydraulic cylinder 2.

In the second embodiment described above, the stroke stoppage of the boom hydraulic cylinder 2 is detected by the detection of the pressure of the return pressured oil. However, a means for detection of the stroke stoppage of the boom hydraulic cylinder 2 can be employed as appropriate. By way of example, a limit switch may provided in the boom hydraulic cylinder 2 whereby detection of the stroke stoppage by the use of this limit switch may be performed.

The first embodiment and second embodiment have hypothesized a hydraulic-type operation lever in which the pilot pressured oil of pilot pressure in accordance with the operation amount of the operation lever is output from the operation lever device 40. However, the present invention can also have application in electrical-type lever devices.

Figure 4:
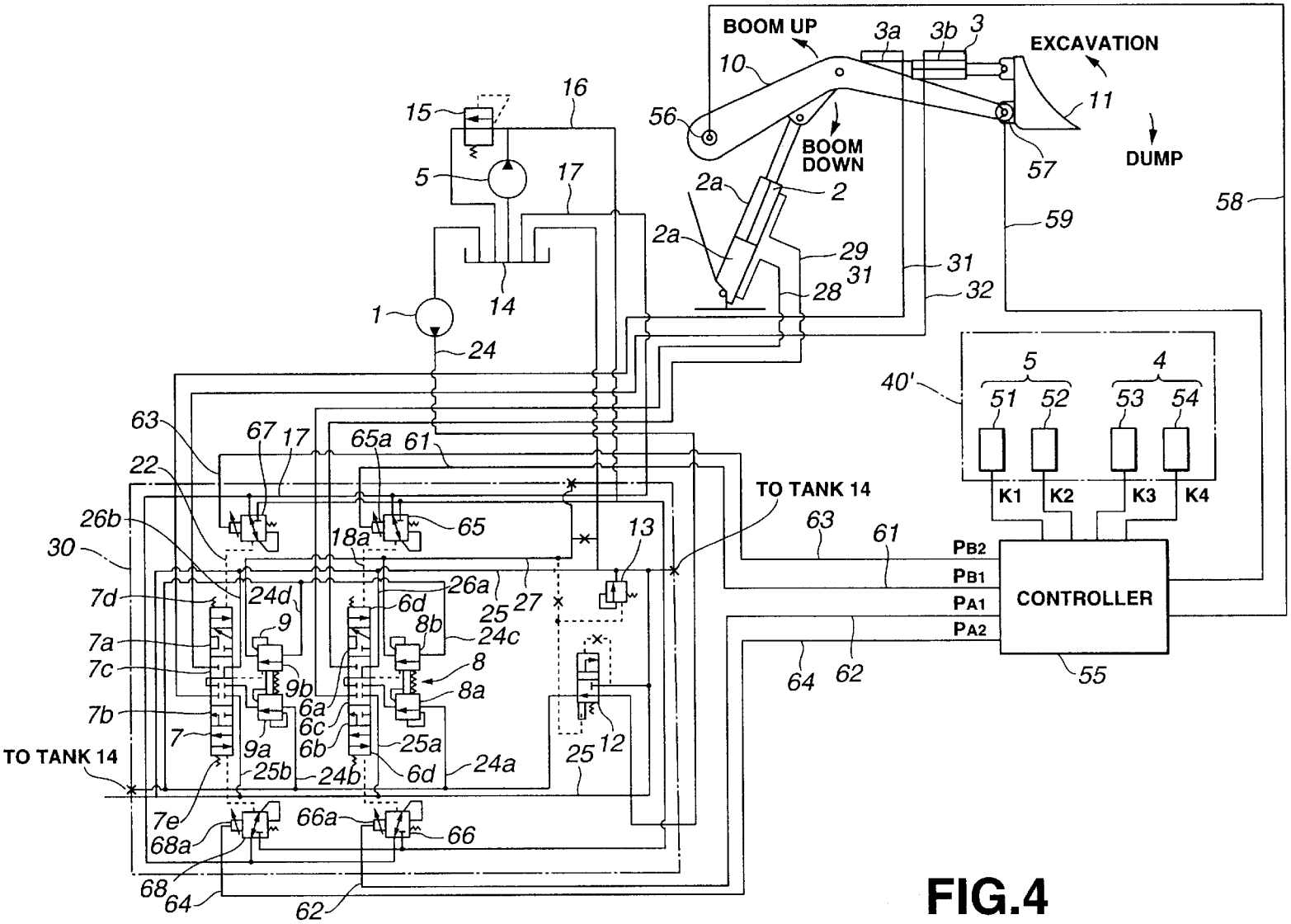
FIG. 4 is a hydraulic circuit diagram of a third embodiment.

FIG. 4 shows a hydraulic circuit of a third embodiment in which an electrical-type operation lever is employed. In the description given below a repetition of the description of the configurative elements which are common to the hydraulic circuit of FIG. 1 has been omitted.

As is shown in FIG. 4, electrical-type operation units 4, 5, which output electrical signals K4, K3, K1 and K2 of a magnitude in accordance with operation amounts S1, S2, are provided in an electrical-type operation lever device 40'.

That is to say, a potentiometer 54 correspondent to the boom lifting side operation direction of the boom operation unit 4 is provided in the operation lever device 40'. In addition, a potentiometer 53 is provided correspondent to the boom lowering side operation direction of the boom operation unit 4. In the same way, a potentiometer 51 is provided correspondent to the dump side operation direction of the bucket operation unit 5. In addition, a potentiometer 52 is provided correspondent to the excavation side operation direction of the bucket operation unit 5.

Electrical signals K4, K3 of a magnitude in accordance with the operation amount S1 of the boom operation unit 4 are respectively output from the potentiometers 54, 53. In the same way, electrical signals K1, K2 of a magnitude in accordance with the operation amount S2 of the boom operation unit 5 are respectively output from the potentiometers 51, 52. The electrical signals K4, K3, K1, K2 are input into a controller 55. Electrical signals PB1, PA1, PB2 and PA2 are output from the controller 55 to electrical signals lines 61, 62, 63, 64.

Pressure-reducing valves 65, 66, 67, 68 are provided in an operation valve unit 30'. The inlet ports of these pressure-reducing valves 65~68 have through-connection to the outlet ports of the pilot hydraulic pump 5 by way of a conduit 17.

A pressure-reducing valve 65 is provided correspondent to the boom ascend side port 6*e* of the boom operation valve 6. The outlet port of the pressure-reducing valve 65 has through-connection to the boom ascend side port 6*d* of the boom operation valve 6 by way of a conduit 18*a*. An electromagnetic solenoid valve 65*a* is provided in the side which opposes the side in which a spring for the pressure-reducing valve 65 is provided. An electrical signal line 61 is connected to the electromagnetic solenoid valve 65*a*. In the same way, a pressure-reducing valve 66 is provided correspondent to a boom descend side port 6*e* of the boom operation valve 6. The outlet port of the pressure-reducing valve 66 has through-connection to the boom descend side port 6*e* of the boom operation valve 6 by way of the conduit 19*a*. An electromagnetic solenoid valve 66*a* is provided in the side which opposes the side in which a spring for the pressure-reducing valve 66 is provided. An electrical signal line 62 is connected to the electromagnetic solenoid valve 66*a*.

In addition, a pressure-reducing valve 67 is provided correspondent to the bucket dump side port 7*d* of the bucket operation valve 7. The outlet port of the pressure-reducing valve 67 has through-connection to the bucket dump side port 7*d* of the bucket operation valve 7 by way of the conduit 22. An electromagnetic solenoid valve 67*a* is provided in the side which opposes the side in which a spring for the pressure-reducing valve 67 is provided. An electrical signal line 63 is connected to the electromagnetic solenoid valve 67*a*. In the same way, a pressure-reducing valve 68 is provided correspondent to the bucket excavation side port 7*e* of the bucket operation valve 7. The outlet port of the pressure-reducing valve 68 has through-connection to the bucket excavation side port 7*e* of the bucket operation valve 7 by way of the conduit 23. An electromagnetic solenoid valve 68*a* is provided in the side which opposes the side in which a spring for the pressure-reducing valve 68 is provided. An electrical signal line 64 is connected to the electromagnetic solenoid valve 68*a*.

In order to improve the precision further, the following may also be implemented.

A potentiometer 56 is provided in the boom 10 to detect the actual rotation angle of the boom 10. A potentiometer 57 is provided in the bucket 11 to detect the actual rotation angle of the bucket 11. Signals which indicate the angles detected by the potentiometers 56, 57 are input to the controller 55 by way of the respective electrical signal lines 58, 59.

Figure 5A:
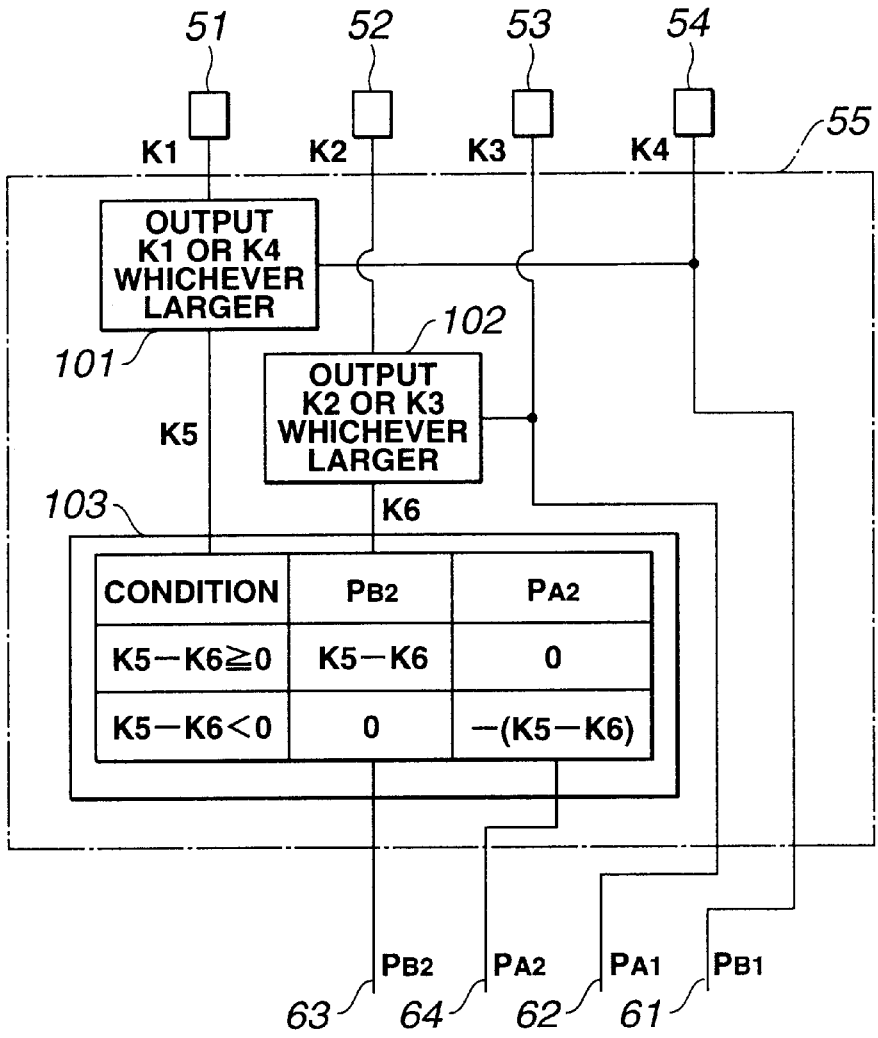
FIGS. 5(*a*), (*b*) are diagrams which show the process details of the control implemented by the controller shown in FIG. 4.
Figure 5B:
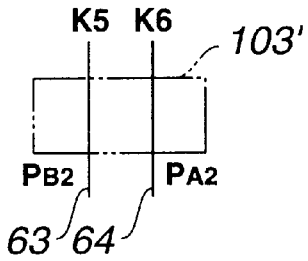

FIG. 5(*a*) is a diagram which shows the processing details performed by the controller 55 shown in FIG. 4.

Next, a description will be given of the operation, with reference to the FIG. 5(*a*), of a third embodiment of FIG. 4.

Now, it is assumed that the operator operates the boom operation unit 4 of the operation lever device 40' to the boom lifting side and, at this time, the bucket operation unit 5 is not incline-operated from the neutral position.

The electrical signal K4, in accordance with the operation amount S1 of the boom operation unit 4, is input into the controller 55 and input into a processing unit 101. In addition, the electrical signal K1, in accordance with the operation amount S2 of the boom operation unit 5, is input into the controller 55 and input into the processing unit 101. The processing unit 101 outputs the largest of the electrical signals K1 , K4. Now, the boom operation unit 4 is incline-operated and the bucket operation unit 5 is in a neutral position so, the electrical signal K4 is larger than the electrical signal K1. For this reason, the electrical signal K4 is output to the processing unit 103 from the processing unit 101 as an electrical signal K5.

In the same way, the electrical signal K3, in accordance with the operation amount S1 of the boom operation unit 4, is input to the controller 55 and input to a processing unit 102. In addition, the electrical signal K2, in accordance with the operation amount S2 of the bucket operation unit 5, is input to the controller 55 and input to the processing unit 102. The larger of the electrical signals K2, K3 is output as electrical signal K6 by the processing unit 102.

Electrical signals PB2, PA2 are produced in accordance with a comparison of the magnitudes of the electrical signals K5, K6 by the processing unit 103.

When KS−K6≧0, the content of the electrical signal PB2 is K5−K6, and the content of the electrical signal PA is 0. In addition, when KS−K6<0, the content of the electrical signal PB2 is 0, and the content of the electrical signal PA is −(KS−K6).

Now, the boom operation unit 4 is not incline-operated to the boom rising side so, the electrical signal K5 is equal to or greater than the electrical signal K6. For this Now, the boom operation unit 4 is not incline-operated to the boom rising side so, the electrical signal K5 is equal to or greater than the electrical signal K6. For this reason, the electrical signal PB2, which has the content K5−K6, is output from the processing unit 103 to the electrical signal line 63, and the electrical signal PA2, of content 0, is output to the electrical signal line 64.

On the other hand, the electrical signal K4 is output to the electrical signal line 61 as the electrical signal PB1 in accordance with the operation amount S1 of the boom operation unit 4.

For this reason, the electrical signal PB1, of a magnitude in accordance with the operation amount S1 of the boom operation unit 4, is applied to the electromagnetic solenoid valve 65*a* of the pressure-reducing valve 65 by way of the electrical signal line 61. The pilot pressured oil is pressure reduced to a magnitude in accordance with the electrical signal PB1 by the pressure-reducing valve 65. The pilot pressured oil of pilot pressure P, in accordance with the electrical signal PB1, is supplied to the boom ascend side port 6*d* of the boom operation valve 6 by way of the pilot conduit 18*a*.

In addition, the electrical signal PB2, of a magnitude in accordance with the operation amount S1 of the boom operation unit 4, is applied to the electromagnetic solenoid valve 67*a* of the pressure-reducing valve 67 by way of the electrical signal line 63. The pilot pressured oil is pressure reduced to a magnitude in accordance with the electrical signal PB2 by the pressure-reducing valve 67. The pilot pressured oil of pilot pressure P, in accordance with the electrical signal PB2, is supplied to the dump side port 7*d* of the bucket operation valve 7 by way of the pilot conduit 22.

For this reason, the boom operation valve 6, in accordance with the pilot pressure P applied to the operation valves 6, 7, is positioned in the boom rising position 6*a* side, and the bucket operation valve 7 is positioned in the boom rise position 7*a* side. At this time, as the pilot pressure P increases, lifting is effected while the ratio of the opening surface area A1 of the boom operation valve 6 and the opening surface area A2 of the bucket operation valve 7 is maintained at the constant ratio b:a as shown in FIG. 3(*b*). By virtue of this, lifting is effected while the ratio of the flow rate Q1 supplied to the bottom chamber 2*a* of the boom hydraulic cylinder 2 and the flow rate Q2 supplied to the bottom chamber 3*a* of the bucket pressured oil cylinder 3 are maintained at an unaltered constant ratio of b:a. As a result, accompanying the operation of the boom 10 to the rising side, the bucket 11 is actuated to the dump side at a constant relationship, and the posture of the bucket 11 with respect to the ground surface is held in the horizontal.

On the other hand, when the operator operates the boom operation unit 4 of the operation lever device 40' to the boom lowering side, in the same way, horizontal hold control is performed which holds the bucket 11 in the horizontal.

That is to say, as shown in the processing unit 103 of FIG. 5(*a*), now, the boom operation unit 4 is incline-operated to the boom lowering side so K−K6<0. For this reason, the electrical signal PB2, of the content 0, is output from the processing unit 103 to the electrical signal line 63, and the electrical signal PA2 of the content −(K5−K6) is output to the electrical signal line 64.

On the other hand, the electrical signal K3 is output to the electrical signal line 62 as the electrical signal PA1 in accordance with the operation amount S1 of the boom operation unit 4.

For this reason, the electrical signal PA1, of a magnitude in accordance with the operation amount S1 of the boom operation unit 4, is applied to the electromagnetic solenoid valve 66*a* of the pressure-reducing valve 66 by way of the electrical signal line 62. The pilot pressured oil is pressure reduced to a magnitude in accordance with the electrical signal PA1 by the pressure-reducing valve 66. The pilot pressured oil of pilot pressure P in accordance with the electrical signal PA1 is supplied to the boom lowering side port 6*e* of the boom operation valve 6 by way of the pilot conduit 19*a*.

In addition, the electrical signal PA2, of a magnitude in accordance with the operation amount S1 of the boom operation unit 4, is applied to the electromagnetic solenoid valve 68*a* of the pressure-reducing valve 68 by way of the electrical signal line 64. The pilot pressured oil is pressure reduced to a magnitude in accordance with the electrical signal PA2 by the pressure-reducing valve 68. The pilot pressured oil of the pilot pressure P in accordance with the electrical signal PA2 is supplied to the excavation side port 7*e* of the bucket operation valve 7 by way of the pilot conduit 23.

For this reason, the boom operation valve 6, in accordance with the pilot pressure P applied to the operation valves 6, 7, is positioned in the boom lowering position 6*b* side, and the bucket operation valve 7 is positioned in the excavation position 7*b* side. At this time, as the pilot pressure P increases, lifting is effected while the ratio of the opening surface area A1 of the boom operation valve 6 and the opening surface area A2 of the bucket operation valve 7 is maintained at the constant ratio b:a as shown in FIG. 3(*b*). By virtue of this, lifting is effected while the ratio of the flow rate Q1 supplied to the bottom chamber 2*a* of the boom hydraulic cylinder 2 and the flow rate Q2 supplied to the bottom chamber 3*a* of the bucket pressured oil cylinder 3 are maintained at the unaltered constant ratio of b:a. As a result, accompanying the operation of the boom 10 to the rising side, the bucket 11 is actuated to the excavation side at a constant relationship, and the posture of the bucket 11 is held in the horizontal with respect to the ground surface.

Signals which indicate the actual angle of the boom 10 and bucket 11 are input to the controller 55 by way of electrical signal lines 58, 59. Thereupon, the angle signal, as a feedback signal, may be controlled in such a way that the actual angle of the boom 10 and bucket 11 matches a target angle. The posture of the bucket 11 with respect to the ground surface can be more precisely held in the horizontal by the matching of the actual angle of the boom 10 and bucket 11 to the target angle.

A variety of modifications to the third embodiment described above are possible.

In FIG. 4, the operation valves 6, 7 are caused to operate by the provision of pressure-reducing valves 65~68, and the conversion of the electrical signals PB1, PA1, PB2 and PA2 to pilot pressure to be supplied to the operation valves 6,7. However, the operation valves 6, 7 may be worked by the configuration of the operation valves 6, 7 as electromagnetic proportion control valves and the direct application of the electrical signals PB1, PA1, PB2 and PA2 on the operation valves 6, 7.

In addition, a processing unit 103' as shown in FIG. 5(*b*) may be adopted instead of the processing unit 103 of FIG. 5(*a*). Using the processing unit 103', the electrical signal K5 is output to the electrical signal line 63 as an electrical signal PB2 and the electrical signal K6 is output to the electrical signal line 64 as an electrical signal PA2.

In the first, second and third embodiments described above, the posture of the bucket 11 is automatically held in the horizontal in response to both the rise and lowering operations of the boom 10. Next, a description will be given of a embodiment in which the bucket 11 posture can be automatically held in the horizontal when an operation which affords the rise only of the boom 10 is performed.

Figure 6:
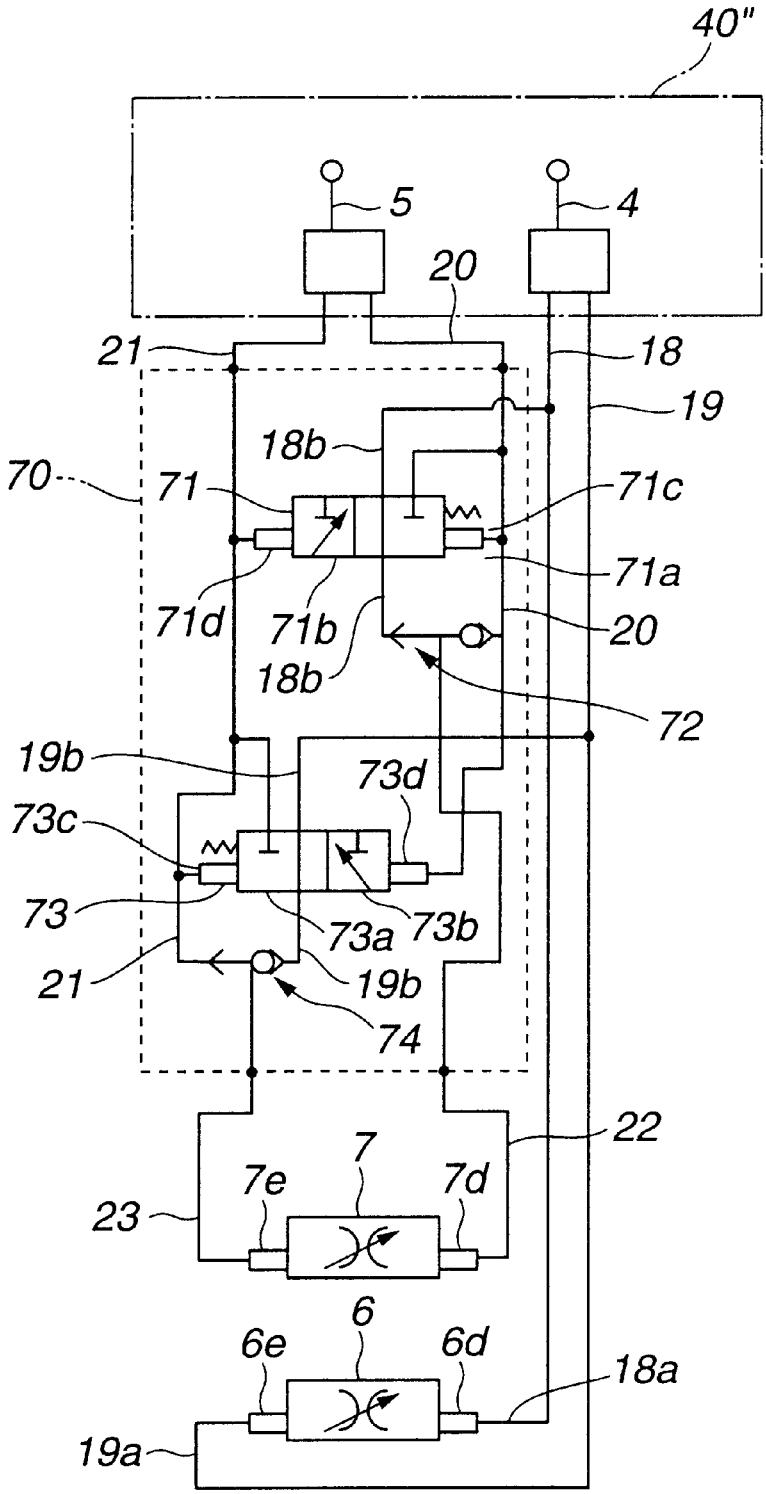
FIG. 6 is a hydraulic circuit diagram of a fourth embodiment.

FIG. 6 shows the hydraulic circuit of the embodiment of FIG. 4. Representation of the configurative elements which are common to FIG. 1 have been omitted in FIG. 6. In addition, the same reference symbols have been used for the same configurative elements common to FIG. 1 and a repetition of the description thereof has been omitted.

As is shown in FIG. 6, the operation lever device 40" is composed of a boom operation unit 4 and bucket operation unit 5.

A circuit for holding the bucket horizontal 70 is provided on the conduit between the bucket operation unit 5 and bucket operation valve 7.

The circuit for holding the bucket horizontal 70 is mainly composed of control valves 71, 73 and shuttle valves 72 and 74. The control valve 71 comprises a valve position 71*a*, in which there is through-connection of a pilot conduit 18*b* with one of the inlet ports of the shuttle valve 72, and a valve position 71*b*, in which there is obstruction of the through-connection of the pilot conduit 18*b* with the other inlet port of the shuttle valve 72.

The other inlet port of the shuttle valve 72 has through-connection to the pilot conduit 20.

The outlet port of the shuttle valve 72 has through-connection to the pilot conduit 22.

A pilot port 71*c* is provided in the side in which the spring of the control valve 71 is provided. The pilot conduit 20 has through-connection to the pilot port 71*c*. In addition, a pilot port 71*d* is provided in the side opposing the pilot port 71*c* of the control valve 71. The pilot conduit 21 has through-connection to the pilot port 71*d*.

In the same way, the control valve 73 comprises a valve position 73*a*, in which there is through-connection of a pilot conduit 19*b* with the one of the inlet ports of the shuttle valve 74, and a valve position 73*b*, in which there is obstruction of the through-connection of the pilot conduit 19*b* with the other inlet port of the shuttle valve 74.

The other inlet port of the shuttle 74 has through-connection to the pilot conduit 21.

The outlet port of the shuttle 74 has through-connection to the pilot conduit 23.

A pilot port 73*c* is provided in the side in which a spring for the control valve 73 is provided. The pilot conduit 21 has through-connection to the pilot port 73*c*. In addition, a pilot port 73*d* is provided in the side opposing the pilot port 73*c* of the control valve 73. The pilot conduit 20 has through-connection to the pilot port 73*d*.

A description will be given of the workings of the fourth embodiment.

Now, it is assumed that the operator operates the boom operation unit 4 of the lever operation device 40" to the boom lifting side. At this time, the bucket operation unit 5 is not incline-operated from the neutral position.

For this reason, the pilot pressured oil of pilot pressure P is output to the pilot conduit 18*a* in accordance with the operation amount S1 of the boom operation unit 4. This pilot pressured oil is supplied to the boom ascend side port 6*d* of the boom operation valve 6 by way of the pilot conduit 18*a*.

In addition, the pilot pressured oil of the pilot pressure P is output to the pilot conduit 18*b* in accordance with the operation amount S1 of the boom operation unit 4.

Now, since the bucket operation unit 5 is in a neutral position, the pressure is not applied to the pilot ports 71*c*, 71*d* of the control valve 71 by way of the pilot conduits 20, 21. For this reason, the control valve 71 is positioned, by the spring forces, in the valve position 71*a*. For this reason, the pilot conduit 18*b* has through-connection to one of the inlet ports of the shuttle valve 72. Now, since the bucket operation unit 5 is in a neutral position, the pressure of the pilot conduit 20, in other words, the pressure of the other inlet port of the shuttle valve 72, constitutes the pressure within the tank 14. For this reason, the pilot pressured oil of pilot pressure P, in accordance with the operation amount S1 of the boom operation unit 4, is output to the pilot conduit 22 by way of the shuttle valve 72. The pilot pressured oil is supplied to the dump side port 7*d* of the bucket operation valve 7 by way of the pilot conduit 22.

For this reason, the boom operation valve 6, in response to the pilot pressure P applied to the operation valves 6, 7, is positioned in the boom rising position 6*a* side, and the bucket operation valve 7 is positioned in the dump position 7*a* side. At this time, as the pilot pressure P increases, lifting is effected while the ratio of the opening surface area A2 of the bucket operation valve 7 and the opening surface area A1 of the boom operation valve 6 is maintained at a constant ratio b:a as shown in FIG. 3(*b*). By virtue of this, lifting is effected while the ratio of the flow rate Q1 supplied to the bottom chamber 2*a* of the boom hydraulic cylinder 2 and the flow rate Q2 supplied to the bottom chamber 3*a* of the bucket pressured oil cylinder 3 is maintained at the above-noted unaltered constant ratio b:a. As a result, accompanying the operation of the boom 10 to the lifting side, the bucket 11 is actuated to the dump side at a constant relationship, and the posture of the bucket 11 with respect to the ground surface is maintained at the horizontal.

When the bucket operation unit 5 is operated to the excavation side, the pilot pressure of the pilot conduit 21 is applied to the pilot port 71*d* of the control valve 71. As a result, the control valve 71 is positioned in the valve position 71*b*. For this reason, the through-connection between the pilot conduit 18*b* and one of the inlet ports of the shuttle valve 72 is obstructed. By virtue of this, the bucket operation valve 7 stops operating in response to the operation of the boom operation unit 4.

The pilot pressure within the pilot conduit 21 is applied to the excavation side port 7*e* of the bucket operation valve 7. For this reason, the bucket operation valve 7 is operated in response to the operation of the bucket operation unit 5 and, in response thereto, the bucket 11 is operated.

When the operator operates the boom operation unit 4 of the operation lever device 40" to the boom lowering side, the control valve 73 and shuttle valve 74 are operated in the same way as the control valve 71 and shuttle valve 72. By virtue of this, accompanying the operation of the boom 10 to the downward side, at a constant relationship, the bucket 11 is operated to the excavation side, and the posture of the bucket 11 is held horizontal with respect to the ground surface.

In the embodiments described above, a description has been given in which horizontal hold control of the posture of the bucket 11 with respect to the ground surface is hypothesized. However, the present invention is not limited to the horizontal posture and can have application provided the posture of the bucket 11 is to be held constant.

In addition, in the embodiments described above, an embodiment has been hypothesized in which the posture of the work device 11 is controlled to a constant posture by the control of the flow ratio of two hydraulic actuators 2, 3 to a constant ratio. However, the range of application of the present invention is in no way limited to a case in which the posture of the work device in the work machine is controlled to a constant posture. The present invention, without limitation to work machine, can have application in a wide range of hydraulic drive machines in which the flow rate ratio of two hydraulic actuators is controlled to a constant ratio.

What is claimed is:

1. An actuator control device for a hydraulic drive machine which comprises:

a hydraulic pump and at least two hydraulic actuators driven by supply of discharged pressured oil from the hydraulic pump;

an operation means each provided correspondent with each hydraulic actuator; and an operation valve connected between each of the operation means and each of its correspondent hydraulic actuator, each operation valve changing its respective opening amount in accordance with an operating amount of each operation means, and which supply pressured oil to the hydraulic actuators correspondent with the operation means, at a flow rate according to the respective opening amount, wherein, the actuator control device further comprises:

front-to-rear differential pressure constant means connected between the hydraulic pump and each of the operation valves which equalize a difference in pressure between a pressure of pressured oil on an upstream side and a pressure of pressured oil on a downstream side of each of the operation valves, and wherein, when one of the operation means is operated, by changing the opening amount of the other one of the operation valves correspondent with the other one of the operation means in accordance with the operation amount of said one of the operation means, the other one of the hydraulic actuators correspondent with said other one of the operation valves is driven.

2. A bucket posture control device for a hydraulic drive machine which comprises:

a hydraulic pump, and a boom hydraulic actuator and a bucket hydraulic actuator driven by supply of discharged pressured oil from the hydraulic pump;

a boom and a bucket operated in accordance with the drive of the boom hydraulic actuator and the bucket hydraulic actuator respectively;

boom operation means and bucket operation means provided correspondent with the boom hydraulic actuator and the bucket hydraulic actuator respectively; and a boom operation valve and a bucket operation valve which change opening amounts thereof in accordance with operating amounts of the boom operation means and the bucket operation means respectively, and which supply pressured oil to the boom hydraulic actuator and the bucket hydraulic actuator respectively, at a flow rate in accordance with the respective opening amounts, wherein the bucket posture control device further comprises:

front-to-rear differential pressure constant means connected between the hydraulic pump and each of the operation valves which equalize a difference in pressure between a pressure of pressured oil on an upstream side and a pressure of pressured oil on a downward side of the boom operation valve and the bucket operation valve respectively and, control means which, when the boom operation means is operated, changes the opening amount of the bucket operation valve in accordance with the operation amount of the boom operation means in such a way that a posture of the bucket is held constant.

3. A bucket posture control device for a hydraulic drive machine which comprises:

a hydraulic pump, and a boom hydraulic actuator and a bucket hydraulic actuator driven by supply of discharged pressured oil from the hydraulic pump;

a boom and a bucket operated in accordance with the drive of the boom hydraulic actuator and the bucket hydraulic actuator respectively;

boom operation means and bucket operation means provided correspondent with the boom hydraulic actuator and the bucket hydraulic actuator respectively, and a boom operation valve and a bucket operation valve which change opening amounts thereof in accordance with operating amounts of the boom operation means and the bucket operation means respectively, and which supply pressured oil to the boom hydraulic actuator and the bucket hydraulic actuator respectively, at a flow rate in accordance with the respective opening amounts, wherein the bucket posture control device further comprises:

front-to-rear differential pressure constant means connected between the hydraulic pump and each of the operation valves which equalize a difference in pressure between a pressure of pressured oil on an upstream side and a pressure of pressured oil on a downward side of the boom operation valve and the bucket operation valve respectively and, control means which, when a boom operation signal is output from the boom operation means to afford a lift operation of the boom, generates a bucket operation signal which affords the actuation of the bucket in a dumping direction in response to the boom operation signal, and changes the opening amount of the bucket operation valve in response to the bucket operation signal in such a way that a posture of the bucket is held constant.

4. The bucket posture control device for the hydraulic drive machine as claimed in claim 2, further comprising stroke stoppage detection means connected to the boom operation valve which detects a stroke stoppage of the boom hydraulic actuator, wherein, when the stroke stoppage of the hydraulic actuator has been detected by the stroke stoppage detection means, the control by the control means is turned off.

5. The bucket posture control device for the hydraulic drive machine as claimed in claim 2, further comprising exhaust flow rate control means connected to the bucket operation valve for controlling, in response to the pressure of the pressured oil supplied to the bucket hydraulic actuator, a flow rate of the pressured oil exhausted from the bucket hydraulic actuator in such a way that the posture of the bucket is held constant.

* * * * *